US010314410B2

(12) United States Patent
Myers et al.

(10) Patent No.: US 10,314,410 B2
(45) **Date of Patent: *Jun. 11, 2019**

(54) PLAY GYMS AND METHODS OF OPERATING THE SAME

(71) Applicants: Peter J. Myers, Wheaton, IL (US); Joseph Paul Sejnowski, North Kingstown, RI (US)

(72) Inventors: Peter J. Myers, Wheaton, IL (US); Joseph Paul Sejnowski, North Kingstown, RI (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/247,144

(22) Filed: Apr. 7, 2014

(65) Prior Publication Data

US 2014/0215713 A1 Aug. 7, 2014

Related U.S. Application Data

(63) Continuation of application No. 13/756,168, filed on Jan. 31, 2013, now Pat. No. 8,764,612, which is a (Continued)

(51) Int. Cl.
*A63B 21/00* (2006.01)
*A47D 13/06* (2006.01)
(Continued)

(52) U.S. Cl.
CPC ..... *A47D 13/066* (2013.01); *A47D 13/00* (2013.01); *A47D 13/06* (2013.01); *A47D 13/063* (2013.01);
(Continued)

(58) Field of Classification Search
CPC ..... A63B 21/00; A63B 17/04; A63B 2208/12; A63B 2210/50; A63B 6/00; A63B 9/00;
(Continued)

(56) References Cited

U.S. PATENT DOCUMENTS 1,574,226 A * 2/1926 Ackermann ..... 5/101
1,630,941 A * 5/1927 Hood ..... 5/97
(Continued)

FOREIGN PATENT DOCUMENTS

CN 2277698 4/1998
CN 2650639 10/2004
(Continued)

OTHER PUBLICATIONS

Century, "Fold 'N Go Deluxe Bassinet," Instruction Manual, Sep. 2000, 12 pages.
(Continued)

*Primary Examiner* — Andrew S Lo
(74) *Attorney, Agent, or Firm* — Hanley, Flight and Zimmerman, LLC

(57) ABSTRACT

Play gyms and methods of operating the same are disclosed. A disclosed example includes a floor mat dimensioned to be positioned within a play yard and/or a bassinet. It also includes a play gym to suspend an object above the mat when the mat is positioned in the play yard and/or the bassinet, and at least one connector to couple the play gym to the mat when the mat is removed from the play yard and/or the bassinet.

10 Claims, 5 Drawing Sheets

Related U.S. Application Data continuation of application No. 13/589,777, filed on Aug. 20, 2012, now Pat. No. 8,388,501, which is a continuation of application No. 12/062,670, filed on Apr. 4, 2008, now Pat. No. 8,257,229, which is a continuation of application No. 10/725,071, filed on Dec. 1, 2003, now Pat. No. 7,376,993, which is a continuation of application No. 10/431,079, filed on May 7, 2003, now abandoned.

(51) Int. Cl.
*A63B 6/00* (2006.01)
*A63B 9/00* (2006.01)
*A63B 17/04* (2006.01)
*A47D 13/00* (2006.01)

(52) U.S. Cl.
CPC ..... *A63B 6/00* (2013.01); *A63B 9/00* (2013.01); *A63B 17/04* (2013.01); *A63B 2208/12* (2013.01); *A63B 2210/50* (2013.01)

(58) Field of Classification Search
CPC ..... A47D 13/00; A47D 13/06; A47D 13/063; A47D 13/066
USPC ..... 482/51, 52, 71, 72, 75, 77; 5/417
See application file for complete search history.

(56) References Cited

U.S. PATENT DOCUMENTS 1,826,810 A * 10/1931 Morishita ..... 248/102
2,065,225 A 12/1936 Kennedy
2,402,861 A 6/1946 Winnick
2,433,504 A 12/1947 Zimmermann
2,464,866 A 3/1949 Holtz
2,475,515 A 7/1949 Potter
2,498,203 A 2/1950 Fischer
D158,030 S 4/1950 Wagner
2,681,659 A 6/1954 Hrinsin
2,699,794 A 1/1955 Potter
2,820,468 A 1/1958 Park et al.
2,927,331 A 3/1960 Ruiz
2,943,287 A 6/1960 Kennedy, Jr.
RE24,845 E 7/1960 Heffeman et al.
2,948,287 A * 8/1960 Rupert ..... E04H 15/28 135/115
2,958,084 A 11/1960 Kenney
2,962,034 A 11/1960 Finlayson
3,223,098 A * 12/1965 Dole Jr. ..... E04H 15/425 135/118
3,448,748 A 6/1969 Walrave
3,546,721 A 12/1970 Cleary
3,706,105 A 12/1972 Nicholas et al.
3,878,570 A 4/1975 Donnelly
3,978,610 A 9/1976 Stubbmann
4,015,297 A 4/1977 Christian
4,043,349 A 8/1977 Gays et al.
4,073,017 A 2/1978 Stevens
4,188,745 A 2/1980 Harvey et al.
4,192,334 A 3/1980 Daws
4,197,681 A 4/1980 Holcombe
4,271,642 A 6/1981 Karr
4,295,302 A 10/1981 Liu
4,335,545 A 6/1982 Couch
4,384,435 A 5/1983 Polise et al.
4,556,391 A * 12/1985 Tardivel ..... A63H 33/00 135/125
D285,880 S 9/1986 Griesenbeck
4,627,588 A 12/1986 Block
4,637,748 A 1/1987 Beavers
4,664,640 A 5/1987 Shindo et al.
4,702,643 A 10/1987 Thilmony
4,722,713 A 2/1988 Williams et al.
4,750,509 A * 6/1988 Kim ..... E04H 15/36 135/135
D298,768 S 11/1988 Dwosh et al.
4,790,340 A 12/1988 Mahoney
4,811,437 A 3/1989 Dillner et al.
4,852,598 A 8/1989 Griesenbeck
4,901,481 A 2/1990 Seeley, Jr.
4,945,584 A 8/1990 Lamantia
5,025,821 A 6/1991 Page et al.
5,069,572 A 12/1991 Niksic
5,076,520 A 12/1991 Bro
5,161,269 A 11/1992 McLean et al.
5,195,551 A 3/1993 Ju
D335,046 S 4/1993 Diaz
D339,922 S 10/1993 Williams
5,293,890 A 3/1994 Park et al.
5,328,286 A 7/1994 Lee
5,333,634 A * 8/1994 Taylor ..... E04H 15/28 135/118
5,339,470 A 8/1994 Shamie
5,356,132 A 10/1994 McEwan et al.
5,370,570 A 12/1994 Harris
D359,869 S 7/1995 Oren
5,478,268 A 12/1995 Au
D366,978 S 2/1996 Mariol
D367,788 S 3/1996 Lawhorn
5,517,707 A 5/1996 Lamantia
5,553,336 A 9/1996 Mariol
D374,692 S 10/1996 Stroud et al.
5,586,345 A 12/1996 Nielsen et al.
D383,625 S 9/1997 Dillner
5,666,986 A 9/1997 Fox
5,672,088 A 9/1997 Chininis
5,697,111 A 12/1997 Dillner et al.
5,778,465 A 7/1998 Myers
5,819,342 A 10/1998 Williams
5,862,548 A 1/1999 Gerhart
5,867,850 A 2/1999 Mariol
D408,192 S 4/1999 Chiang
5,904,344 A 5/1999 Pope et al.
5,911,653 A 6/1999 Cheng
5,928,054 A 7/1999 Mast
5,930,854 A * 8/1999 O'Neill ..... A47D 13/063 135/135
5,951,360 A 9/1999 Fearon et al.
5,987,822 A 11/1999 McNiff et al.
5,991,943 A 11/1999 Morris
6,041,455 A 3/2000 Raffo et al.
6,067,676 A 5/2000 Carnahan et al.
6,099,377 A 8/2000 Pridemore
6,109,280 A 8/2000 Custer
6,113,455 A 9/2000 Whelan et al.
6,123,091 A 9/2000 Flynn et al.
6,148,456 A * 11/2000 Tharalson ..... A47C 29/003 5/11
D435,883 S * 1/2001 Laosunthara ..... D21/834
6,178,978 B1 1/2001 Rieber
6,192,535 B1 2/2001 Warner, Jr. et al.
6,199,230 B1 3/2001 Parikh
6,200,060 B1 3/2001 Vernay
6,250,837 B1 6/2001 Mariol et al.
6,263,894 B1 7/2001 LaMantia
6,296,415 B1 10/2001 Johnson et al.
6,301,731 B1 10/2001 Jakubowski et al.
6,305,037 B1 10/2001 Cheng
6,336,234 B1 1/2002 Kuo
6,345,639 B2 2/2002 Rousselle et al.
6,357,462 B1 * 3/2002 Laosunthara ..... A47D 13/063 135/115
6,418,575 B1 7/2002 Cheng
6,464,555 B1 10/2002 Paduano
6,467,107 B1 * 10/2002 Glover ..... A47C 7/66 135/125
6,510,569 B1 1/2003 Hu
6,516,823 B1 2/2003 Glover et al.
6,539,563 B1 4/2003 Hsia
6,550,083 B1 * 4/2003 LaMantia ..... A47C 29/003 135/96
6,561,823 B1 5/2003 Konno

(56) References Cited

U.S. PATENT DOCUMENTS

| | | | |
|---|---|---|---|
| 6,578,211 | B2 | 6/2003 | Tharalson et al. |
| 6,604,844 | B2 | 8/2003 | Hussey |
| 6,640,985 | B1 | 11/2003 | Cheng |
| 6,679,643 | B1 | 1/2004 | Ham |
| 6,702,643 | B1 | 3/2004 | Drosendahl et al. |
| 6,711,760 | B1 | 3/2004 | Yang |
| 6,735,796 | B2 | 5/2004 | Warner, Jr. et al. |
| 6,785,921 | B1 | 9/2004 | Conforti |
| 6,810,545 | B1 | 11/2004 | Darling et al. |
| 6,848,460 | B2 | 2/2005 | Zheng |
| 7,036,161 | B2 | 5/2006 | Harrison et al. |
| 7,037,170 | B2 | 5/2006 | Pacella et al. |
| 7,040,585 | B2 | 5/2006 | Cheng et al. |
| 7,096,874 | B2 | 8/2006 | Forshpan |
| 7,153,181 | B2 | 12/2006 | Cheng et al. |
| 7,376,993 | B2 | 5/2008 | Myers et al. |
| 8,257,229 | B2 | 9/2012 | Myers et al. |
| 8,388,501 | B2 | 3/2013 | Myers et al. |
| 8,764,612 | B2 | 7/2014 | Myers et al. |
| 2002/0023673 | A1 | 2/2002 | Hussey |
| 2008/0188355 | A1 | 8/2008 | Myers et al. |
| 2009/0253342 | A1 | 10/2009 | Oren et al. |
| 2012/0309592 | A1 | 12/2012 | Myers et al. |
| 2013/0139322 | A1 | 6/2013 | Myers et al. |

FOREIGN PATENT DOCUMENTS

| | | | |
|---|---|---|---|
| CN | 2689824 | | 4/2005 |
| EP | 0930035 | A1 | 7/1999 |
| EP | 0789526 | | 10/2002 |
| GB | 2249331 | | 5/1992 |
| NL | 8400112 | | 8/1985 |
| TW | 311860 | | 7/1997 |
| TW | 318359 | | 10/1997 |
| TW | 410668 | | 11/2000 |
| TW | 436193 | | 5/2001 |
| TW | 588619 | | 5/2004 |

OTHER PUBLICATIONS

Century, "Fold 'N Go," retrieved Dec. 14, 2009, 1 page.
Fisher Price, "Bounce and Play," Instruction Manual, 12 pages.
Babytrend Products, "Nursery Care Center and Playard," retrieved Dec. 15, 2009, 1 page.
Babytrend Products, "B. Trend Nursery Center," retrieved Dec. 15, 2009, 1 page.
Tiny Love Products, "Gymini 3-D Activity Gym," retrieved Dec. 15, 2009, 1 page.
Kids II, "Play to Learn Toys," retrieved Dec. 15, 2009, 3 pages.
Kids II, "Pooh Play Gym," retrieved Dec. 15, 2009, 2 pages.
Fisher Price, Kick 'n Crawl Barn, retrieved Dec. 15, 2009, 2 pages.
Baby Product Research, "Essential Baby Products," retrieved Aug. 25, 2009, 24 pages.
Six Innovative New Products Now Available from Evenflo, Business Wire, Dec. 3, 2002, 2 pages.
United States Patent and Trademark Office, "Notice of Failure to Comply with Inter Partes Reexamination Request Filing Requirements," mailed Dec. 11, 2009, 6 pages.
Fisher Price, "Motion and Music Jungle Gym," Model No. 74067, 2003, 8 pages.
Graco, "Pack 'N Play," Owners Manual, Nov. 2001, 21 pages.
Century, "Playard with Bassinet/Changer," Fold-n-Go Care Center, Instruction Manual, Jan. 1998, 12 pages.
United States Patent and Trademark Office, "Notice of Allowance," issued in connection with U.S. Appl. No. 10/725,071, mailed Feb. 26, 2008, 6 pages.
United States Patent and Trademark Office, "Final Office Action," issued in connection with U.S. Appl. No. 10/725,071, mailed Aug. 21, 2007, 14 pages.
United States Patent and Trademark Office, "Non-Final Office Action," issued in connection with U.S. Appl. No. 10/725,071, mailed Nov. 30, 2006, 11 pages.
United States Patent and Trademark Office, "Non-Final Office Action," issued in connection with U.S. Appl. No. 10/725,071, mailed May 2, 2006, 11 pages.
United States Patent and Trademark Office, "Non-Final Office Action," issued in connection with U.S. Appl. No. 10/725,071, mailed Nov. 8, 2005, 10 pages.
United States Patent and Trademark Office, "Non-Final Office Action," issued in connection with U.S. Appl. No. 10/725,071, mailed Apr. 4, 2005, 17 pages.
*Kolcraft Enterprises, Inc.* v. *Graco Children's Products, Inc. and Chicco USA, Inc.*, "Complaint for Patent Infringement," filed with the United States District Court for the Northern District of Illinois, case No. 09-cv-03339, filed Jun. 3, 2009, 4 pages.
*Kolcraft Enterprises, Inc.* v. *Graco Children's Products, Inc. and Chicco USA, Inc.*, "Local Rule 3.4 Notice of Claims Involving Patents," filed with the United States District Court for the Northern District of illinois, case No. 09-cv-03339, filed Jun. 3, 2009, 1 page.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Jul. 9, 2009, 1 page.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Aug. 5, 2009, 1 page.
*Kolcraft Enterprises, Inc.* v. *Graco Children's Products, Inc. and Chicco USA, Inc.*, "Defendant Chicco USA, Inc.'s Answer, Affirmative Defenses, and Counterclaims to Complaint," filed with the United States District Court for the Northern District of Illinois, case No. 09-cv-03339, filed Aug. 20, 2009, 22 pages.
*Kolcraft Enterprises, Inc.* v. *Graco Children's Products, Inc. and Chicco USA, Inc.*, "Defendant Chicco USA, Inc.'s Motion to Transfer Venue," filed with the United States District Court for the Northern District of illinois, case No. 09-cv-03339, filed Aug. 20, 2009, 10 pages.
*Kolcraft Enterprises, Inc.* v. *Graco Children's Products, Inc. and Chicco USA, Inc.*, "Defendant Chicco USA, Inc.'s Memorandum of Law in Support of its Motion to Transfer Venue," with exhibits A-C, filed with the United States District Court for the Northern District of Illinois, case No. 09-cv-03339, filed Aug. 20, 2009, 22 pages.
*Kolcraft Enterprises, Inc.* v. *Graco Children's Products, Inc. and Chicco USA, Inc.*, "Docket Entry Text," issued by the United States District Court for the Northern District of Illinois, case No. 09-cv-03339, filed Aug. 26, 2009, 1 page.
*Kolcraft Enterprises, Inc.* v. *Graco Children's Products, Inc. and Chicco USA, Inc.*, "Plaintiffs Response to Chicco's Counterclaims," filed with the United States District Court for the Northern District of Illinois, case No. 09-cv-03339, filed Aug. 31, 2009, 7 pages.
*Kolcraft Enterprises, Inc.* v. *Graco Children's Products, Inc. and Chicco USA, Inc.*, "Plaintiffs Response to Defendant's Motion to Transfer," case 1:09-cv-03339, document 30, filed Sep. 11, 2009, 9 pages.
*Kolcraft Enterprises, Inc.* v. *Graco Children's Products, Inc. and Chicco USA, Inc.*, "Declaration of Thomas N. Koltun Support of Plaintiffs Response to Defendant's Motion to Transfer," filed with the United States District Court for the Northern District of Illinois, case No. 09-cv-03339, filed Sep. 11, 2009, 3 pages.
*Kolcraft Enterprises, Inc.* v. *Graco Children's Products, Inc. and Chicco USA, Inc.*, "Confidentiality Stipulation and Protective Order," filed with the United States District Court for the Northern District of Illinois, case No. 09-cv-03339, filed Sep. 14, 2009, 10 pages.
*Kolcraft Enterprises, Inc.* v. *Graco Children's Products, Inc. and Chicco USA, Inc.*, "Opinion and Order," issued by the United States District Court for the Northern District of Illinois,case No. 09-cv-03339, filed Oct. 23, 2009, 8 pages.
*Kolcraft Enterprises, Inc.* v. *Graco Children's Products, Inc. and Chicco USA, Inc.*, "Defendant Chicco USA Inc.'s Motion to Stay the Proceedings Pending Reexamination of the Patent Suit," filed with the United States District Court for the Northern District of Illinois, case No. 09-cv-03339, filed Nov. 4, 2009, 2 pages.
*Kolcraft Enterprises, Inc.* v. *Graco Children's Products, Inc. and Chicco USA, Inc.*, "Notice of Motion," filed with the United States

(56) References Cited

OTHER PUBLICATIONS

District Court for the Northern District of Illinois, case No. 09-cv-03339, filed Nov. 4, 2009, 1 page.
*Kolcraft Enterprises, Inc.* v. *Graco Children's Products, Inc. and Chicco USA, Inc.*, "Defendant Chicco USA, Inc.'s Memorandum of Law in Support of its Motion to Stay the Proceedings Pending Reexamination of the Patent Suit," filed with the United States District Court for the Northern District of Illinois, case No. 09-cv-03339, filed Nov. 4, 2009, 11 pages.
*Kolcraft Enterprises, Inc.* v. *Graco Children's Products, Inc. and Chicco USA, Inc.*, "Exhibits A and B," filed with the United States District Court for the Northern District of Illinois, case No. 09-cv-03339, filed Nov. 5, 2009, 6 pages.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Nov. 13, 2009, 1 page.
"Request for Inter Partes Reexamination," filed with the United States Patent and Trademark Office on Nov. 2, 2009, 120 pages.
"Request for Inter Partes Reexamination," Exhibit A, filed with the United States Patent and Trademark Office on Nov. 2, 2009, 12 pages.
"Request for Inter Partes Reexamination," Exhibit B, filed with the United States Patent and Trademark Office on Nov. 2, 2009, 10 pages.
"Request for Inter Partes Reexamination," Exhibit C, filed with the United States Patent and Trademark Office on Nov. 2, 2009, 13 pages.
"Request for Inter Partes Reexamination," Exhibit D, filed with the United States Patent and Trademark Office on Nov. 2, 2009, 36 pages.
"Request for Inter Partes Reexamination," Exhibit E, filed with the United States Patent and Trademark Office on Nov. 2, 2009, 7 pages.
"Request for Inter Partes Reexamination," Exhibit F, filed with the United States Patent and Trademark Office on Nov. 2, 2009, 16 pages.
"Request for Inter Partes Reexamination," Exhibit G, filed with the United States Patent and Trademark Office on Nov. 2, 2009, 7 pages.
"Request for Inter Partes Reexamination," Exhibit H, filed with the United States Patent and Trademark Office on Nov. 2, 2009, 17 pages.
"Request for Inter Partes Reexamination," Exhibit I, filed with the United States Patent and Trademark Office on Nov. 2, 2009, 10 pages.
"Request for Inter Partes Reexamination," Exhibit J, filed with the United States Patent and Trademark Office on Nov. 2, 2009, 23 pages.
The United States Patent and Trademark Office,"Judgment: Termination of the Proceeding," issued in connection with Case No. IPR2014-01053, entered Apr. 3, 2015, 7 pages.
The United States Patent and Trademark Office,"Notice of Filing Date Accorded to Petition and Time for Filing Patent Owner Preliminary Response," issued in connection with Case No. IPR2015-00286, mailed Dec. 9, 2014, 3 pages.
The United States Patent and Trademark Office, "Decision, Institution of Inter Partes Review 37 C.F.R. 42.108," issued in connection with Case No. IPR2014-01053, entered Dec. 19, 2014, 34 pages.
"Second Petition for Inter Partes Review of U.S. Pat. No. 8,388,501," with exhibits, filed with the United States Patent and Trademark Office on Jan. 20, 2015, 197 pages.
The United States Patent and Trademark Office,"Notice of Filing Date Accorded to Petition and Time for Filing Patent Owner Preliminary Response," issued in connection with Case No. IPR2015-00582, mailed Feb. 4, 2015, 3 pages.
The United States Patent and Trademark Office,"Decision on Request for Rehearing," issued in connection with Case No. IPR2014-01053, mailed Mar. 6, 2015, 8 pages.
The Patent Trial and Appeal Board of the United States Patent and Trademark Office, "Decision on Appeal," issued in connection with reexamination Control No. 95000514, corresponding to U.S. Pat. No. 7,376,993, issued from U.S. Appl. No. 10/725,071, mailed on Dec. 9, 2013, 31 pages.
*Kolcraft Enterprises, Inc.* v. *Artsana USA, Inc. d/b/a Chicco USA. Inc. and Artsana, S.p.A. d/b/a Artsana Group*, "Complaint for Patent Infringement," filed with the United States District Court for the Northern District of Illinois Eastern Division, case No. 1:13-CV-04863, filed Jul. 8, 2013, 6 pages.
*Kolcraft Enterprises, Inc.* v. *Chicco USA, Inc. d/b/a Artsana USA, Inc.*, "Transcript of Proceedings—Markman Hearing Before the Honorable Edmond E. Chang," filed with the United States District Court for the Northern District of Illinois Eastern Division, case No. 1:09-CV-03339, Feb. 19, 2013, 87 pages.
*Kolcraft Enterprises, Inc.* v. *Chicco USA, Inc.*, "Defendant's Comments in Response to Plaintiff's Notice of Filing Additional Claim Construction Authority," filed with the United States District Court for the Northern District of Illinois Eastern Division, case No. 1:09-CV-03339, filed May 8, 2013, 2 pages.
*Kolcraft Enterprises, Inc.* v. *Chicco USA, Inc.*, "Defendant's Brief in Support of the Terms of U.S. Pat. No. 7,376,993 That Require Construction," filed with the United States District Court for the Northern District of Illinois Eastern Division, case No. 1:09-CV-03339, filed Nov. 13, 2012, 30 pages.
*Kolcraft Enterprises, Inc.* v. *Chicco USA, Inc.*, "Defendant's Brief in Support of the Terms of U.S. Pat. No. 7,376,993 That Require Construction—Exhibit A," filed with the United States District Court for the Northern District of Illinois Eastern Division, case No. 1:09-CV-03339, filed Nov. 13, 2012, 3 pages.
*Kolcraft Enterprises, Inc.* v. *Chicco USA, Inc.*, "Defendant's Brief in Support of the Terms of U.S. Pat. No. 7,376,993 That Require Construction—Exhibit B," filed with the United States District Court for the Northern District of Illinois Eastern Division, case No. 1:09-CV-03339, filed Nov. 13, 2012, 6 pages.
*Kolcraft Enterprises, Inc.* v. *Chicco USA, Inc. d/b/a Artsana USA, Inc.*, "Notice of Filing of Additional Claim Construction Authority," filed with the United States District Court for the Northern District of Illinois Eastern Division, case No. 1:09-CV-03339, filed May 2, 2013, 2 pages.
*Kolcraft Enterprises, Inc.* v. *Chicco USA, Inc. d/b/a Artsana USA, Inc.*, "Notice of Filing of Additional Claim Construction Authority—Exhibit 1," filed with the United States District Court for the Northern District of Illinois Eastern Division, case No. 1:09-CV-03339, filed May 2, 2013, 14 pages.
*Kolcraft Enterprises, Inc.* v. *Chicco USA, Inc.*, "Defendant Artsana USA, Inc.'s Post Markman Hearing Brief," filed with the United States District Court for the Northern District of Illinois Eastern Division, case No. 1:09-CV-03339, filed Mar. 11, 2013, 22 pages.
*Kolcraft Enterprises, Inc.* v. *Chicco USA, Inc. d/b/a Artsana USA, Inc.*, "Plaintiff's Post-Hearing Claim Construction Brief," filed with the United States District Court for the Northern District of Illinois Eastern Division, case No. 1:09-CV-03339, filed Mar. 11, 2013, 7 pages.
*Kolcraft Enterprises, Inc.* v. *Chicco USA, Inc. d/b/a Artsana USA, Inc.*, "Plaintiff's Post-Hearing Claim Construction Brief—Exhibit A," filed with the United States District Court for the Northern District of Illinois Eastern Division, case No. 1:09-CV-03339, filed Mar. 11, 2013, 6 pages.
*Kolcraft Enterprises, Inc.* v. *Chicco USA, Inc. d/b/a Artsana USA, Inc.*, "Joint Claim Construction Chart," filed with the United States District Court for the Northern District of Illinois Eastern Division, case No. 1:09-CV-03339, filed Jan. 7, 2013, 5 pages.
*Kolcraft Enterprises, Inc.* v. *Chicco USA, Inc. d/b/a Artsana USA, Inc.*, "Plaintiff's Claim Construction Response Redacted Public Version," filed with the United States District Court for the Northern District of Illinois Eastern Division, case No. 1:09-CV-03339, filed Dec. 11, 2012, 32 pages.
*Kolcraft Enterprises, Inc.* v. *Chicco USA, Inc. d/b/a Artsana USA, Inc.*, "Plaintiff's Claim Construction Response Redacted Public Version—Exhibit 1," filed with the United States District Court for the Northern District of Illinois Eastern Division, case No. 1:09-CV-03339, filed Dec. 11, 2012, 4 pages.
*Kolcraft Enterprises, Inc.* v. *Chicco USA, Inc. d/b/a Artsana USA, Inc.*, "Plaintiff's Claim Construction Response Redacted Public

(56) References Cited

OTHER PUBLICATIONS

Version—Exhibit 2," filed with the United States District Court for the Northern District of Illinois Eastern Division, case No. 1:09-CV-03339, filed Dec. 11, 2012, 2 pages.
*Kolcraft Enterprises, Inc.* v. *Chicco USA, Inc. d/b/a Artsana USA, Inc.*, "Exhibit 3 to Plaintiff's Claim Construction Response Filed Under Seal Pursuant to LR 26.2," filed with the United States District Court for the Northern District of Illinois Eastern Division, case No. 1:09-CV-03339, filed Dec. 11, 2012, 1 page.
*Kolcraft Enterprises, Inc.* v. *Chicco USA, Inc. d/b/a Artsana USA, Inc.*, "Plaintiff's Claim Construction Response Redacted Public Version—Exhibit 4," filed with the United States District Court for the Northern District of Illinois Eastern Division, case No. 1:09-CV-03339, filed Dec. 11, 2012, 5 pages.
*Kolcraft Enterprises, Inc.* v. *Chicco USA, Inc. d/b/a Artsana USA, Inc.*, "Plaintiff's Claim Construction Response Redacted Public Version—Exhibit 5," filed with the United States District Court for the Northern District of Illinois Eastern Division, case No. 1:09-CV-03339, filed Dec. 11, 2012, 3 pages.
*Kolcraft Enterprises, Inc.* v. *Chicco USA, Inc.*, "Defendant's Reply to Plaintiffs Claim Construction Response," filed with the United States District Court for the Northern District of Illinois Eastern Division, case No. 1:09-CV-03339, filed Jan. 3, 2013, 20 pages.
*Kolcraft Enterprises, Inc.* v. *Chicco USA, Inc.*, "Defendant's Reply to Plaintiffs Claim Construction Response—Exhibit A," filed with the United States District Court for the Northern District of Illinois Eastern Division, case No. 1:09-CV-03339, filed Jan. 3, 2013, 5 pages.
*Kolcraft Enterprises, Inc.* v. *Chicco USA, Inc.*, "Defendant's Reply to Plaintiffs Claim Construction Response—Exhibit B," filed with the United States District Court for the Northern District of Illinois Eastern Division, case No. 1:09-CV-03339, filed Jan. 3, 2013, 6 pages.
United States Patent and Trademark Office, "Examiner's Answer to Appeal Brief," issued in connection with reexamination control No. 95000514, corresponding to U.S. Pat. No. 7,376,993, mailed Mar. 13, 2013, 3 pages.
"Rebuttal Brief-Requester," filed with the United States Patent and Trademark Office on Apr. 15, 2013, in connection with reexamination control No. 95000514, corresponding to U.S. Pat. No. 7,376,993, 31 pages.
United States Patent and Trademark Office, "Reply Brief Noted-Patent Board," issued in connection with reexamination control No. 95000514, corresponding to U.S. Pat. No. 7,376,993, mailed May 28, 2013, 3 pages.
United States Patent and Trademark Office, "Appeal Docketing Notice," issued in connection with reexamination control No. 95000514, corresponding to U.S. Pat. No. 7,376,993, mailed Jul. 10, 2013, 3 pages.
Page from section 6.08.02 of the MPEP showing cross hatching showing specific materials, retrieved from http://www.uspto.gov/web/offices/pac/mpep/mpep_html_graphics/608_02-l.jpg on Oct. 26, 2011.
"Respondent Brief," filed with the United States Patent and Trademark Office on Jul. 15, 2012, in connection with reexamination control No. 95000514, corresponding to U.S. Pat. No. 7,376,993, 15 pages.
"Respondent Brief," Exhibit A, filed with the United States Patent and Trademark Office on Jul. 15, 2012, in connection with reexamination control No. 95000514, corresponding to U.S. Pat. No. 7,376,993, 17 pages.
"Respondent Brief," Exhibit B, filed with the United States Patent and Trademark Office on Jul. 15, 2012, in connection with reexamination control No. 95000514, corresponding to U.S. Pat. No. 7,376,993, 9 pages.
"Respondent Brief," Exhibit C, filed with the United States Patent and Trademark Office on Jul. 15, 2012, in connection with reexamination control No. 95000514, corresponding to U.S. Pat. No. 7,376,993, 26 pages.
"Respondent Brief," Exhibit D, filed with the United States Patent and Trademark Office on Jul. 15, 2012, in connection with reexamination control No. 95000514, corresponding to U.S. Pat. No. 7,376,993, 22 pages.
"Respondent Brief," Exhibit E, filed with the United States Patent and Trademark Office on Jul. 15, 2012, in connection with reexamination control No. 95000514, corresponding to U.S. Pat. No. 7,376,993, 8 pages.
"Respondent Brief," Exhibit F, filed with the United States Patent and Trademark Office on Jul. 15, 2012, in connection with reexamination control No. 95000514, corresponding to U.S. Pat. No. 7,376,993, 16 pages.
"Respondent Brief," Exhibit G, filed with the United States Patent and Trademark Office on Jul. 15, 2012, in connection with reexamination control No. 95000514, corresponding to U.S. Pat. No. 7,376,993, 9 pages.
"Respondent Brief." Exhibit H, filed with the United States Patent and Trademark Office on Jul. 15, 2012, in connection with reexamination control No. 95000514, corresponding to U.S. Pat. No. 7,376,993, 8 pages.
United States Patent and Trademark Office, "Notice of Allowance," issued in connection with U.S. Appl. No. 12/062,670, mailed Jul. 26, 2012, 56 pages.
United States Patent and Trademark Office, "Non-Final Office Action," issued in connection with U.S. Appl. No. 12/062,670, mailed Dec. 29, 2011,31 pages.
United States Patent and Trademark Office, "Restriction Requirement," issued in connection with U.S. Appl. No. 12/062,670, mailed Jan. 24, 2011, 9 pages.
United States Patent and Trademark Office, "Restriction Requirement," issued in connection with U.S. Appl. No. 12/062,670, mailed Apr. 28, 2010,6 pages.
*Kolcraft Enterprises, Inc.* v. *Chicco USA, Inc. d/b/a Artsana USA Inc.*, "Plaintiff's Final Response to Defendant's Final Invalidity Contentions," filed with the United States District Court for the Northern District of Illinois Eastern Division, case No. 1:09-cv-03339, filed Sep. 25, 2012, 9 pages.
*Kolcraft Enterprises, Inc.* v. *Chicco USA, Inc. d/b/a Artsana USA Inc.*, "Artsana's Final Invalidity Contentions," filed with the United States District Court for the Northern District of Illinois Eastern Division, case No. 1:09-cv-03339, served Aug. 28, 2012, filed Sep. 25, 2012, 19 pages.
*Kolcraft Enterprises, Inc.* v. *Chicco USA, Inc. d/b/a Artsana USA Inc.*, "Plaintiff's Final Response to Defendant's Final Invalidity Contentions," Exhibit A, filed with the United States District Court for the Northern District of Illinois Easter Division, case No. 1:09-cv-03339, filed Sep. 25, 2012, 11 pages.
*Kolcraft Enterprises, Inc.* v. *Chicco USA, Inc. d/b/a Artsana USA Inc.*, "Plaintiff's Final Response to Defendant's Final Invalidity Contentions," Exhibit B, filed with the United States District Court for the Northern District of Illinois Easter Division, case No. 1:09-cv-03339, filed Sep. 25, 2012, 9 pages.
*Kolcraft Enterprises, Inc.* v. *Chicco USA, Inc.*, "Defendant's Brief in Support of the Terms of U.S. Pat. No. 7,376,993 that Require Construction," filed with the United States District Court for the Northern District of Illinois Eastern Division, case No. 1:09-cv-03339, document #146, filed Nov. 13, 2012, 30 pages.
*Kolcraft Enterprises, Inc.* v. *Chicco USA, Inc.*, "Defendant's Brief in Support of the Terms of U.S. Pat. No. 7,376,993 that Require Construction," Exhibit A, filed with the United States District Court for the Northern District of Illinois Eastern Division, case No. 1:09-cv-03339, document #146-1, filed Nov. 13, 2012, 3 pages.
*Kolcraft Enterprises, Inc.* v. *Chicco USA, Inc.*, "Defendant's Brief in Support of the Terms of U.S. Pat. No. 7,376,993 that Require Construction," Exhibit B, filed with the United States District Court for the Northern District of Illinois Eastern Division, case No. 1:09-cv-03339, document #146-2, filed Nov. 13, 2012, 6 pages.
United States Patent and Trademark Office, "Notice of Allowance," issued in connection with U.S. Appl. No. 13/589,777, mailed Jan. 15, 2013,46 pages.
United States Patent and Trademark Office, "Non-Final Office Action," issued in connection with U.S. Appl. No. 13/589,777, mailed Sep. 26, 2012, 8 pages.

(56) References Cited

OTHER PUBLICATIONS

United States Patent and Trademark Office, "Inter Partes Reexamination Office Action Closing Prosecution" issued in connection with reexamination control No. 95000514, mailed on Nov. 2, 2011, 50 pages.
"Replacement Request for Inter Partes Reexamination," Exhibit K, filed with the United States Patent and Trademark Office on Jan. 8, 2010, 12 pages.
"Replacement Request for Inter Partes Reexamination," Exhibit L, filed with the United States Patent and Trademark Office on Jan. 8, 2010, 6 pages.
"Replacement Request for Inter Partes Reexamination," Exhibit M, filed with the United States Patent and Trademark Office on Jan. 8, 2010, 1 page.
"Replacement Request for Inter Partes Reexamination," Exhibit N, filed with the United States Patent and Trademark Office on Jan. 8, 2010, 8 pages.
"Replacement Request for Inter Partes Reexamination," Exhibit O, filed with the United States Patent and Trademark Office on Jan. 8, 2010, 21 pages.
"Replacement Request for Inter Partes Reexamination," Exhibit P, filed with the United States Patent and Trademark Office on Jan. 8, 2010, 12 pages.
"Replacement Request for Inter Partes Reexamination," Exhibit Q, filed with the United States Patent and Trademark Office on Jan. 8, 2010, 14 pages.
"Replacement Request for Inter Partes Reexamination," Exhibit R, filed with the United States Patent and Trademark Office on Jan. 8, 2010, 7 pages.
"Replacement Request for Inter Partes Reexamination," Exhibit S, filed with the United States Patent and Trademark Office on Jan. 8, 2010, 16 pages.
"Replacement Request for Inter Partes Reexamination," Exhibit T, filed with the United States Patent and Trademark Office on Jan. 8, 2010, 15 pages.
"Replacement Request for Inter Partes Reexamination," Exhibit U, filed with the United States Patent and Trademark Office on Jan. 8, 2010, 8 pages.
"Replacement Request for Inter Partes Reexamination," Exhibit V, filed with the United States Patent and Trademark Office on Jan. 8, 2010, 7 pages.
"Replacement Request for Inter Partes Reexamination," Exhibit W, filed with the United States Patent and Trademark Office on Jan. 8, 2010, 3 pages.
"Replacement Request for Inter Partes Reexamination," Exhibit X, filed with the United States Patent and Trademark Office on Jan. 8, 2010, 4 pages.
United States Patent and Trademark Office, "Decision on Request for Inter Partes Reexamination," issued in connection with U.S. Appl. No. 95/000,514, corresponding to U.S. Pat. No. 7,376,993 issued from parent U.S. Appl. No. 10/725,071, mailed Feb. 12, 2010, 27 pages.
United States Patent and Trademark Office, "Inter Partes Reexamination Office Action," issued in connection with U.S. Appl. No. 95/000,514, corresponding to U.S. Pat. No. 7,376,993 issued from parent U.S. Appl. No. 10/725,071, mailed Feb. 12, 2010, 21 pages.
"Response to the Office Action Dated Feb. 12, 2010," filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 50 pages.
"Response to the Office Action Dated Feb. 12, 2010," Appendix A, Rule 131 Declaration of James A. Flight, with exhibits 1-7, filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 12 pages.
"Response to the Office Action Dated Feb. 12, 2010," Appendix B, filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 4 pages.
"Response to the Office Action Dated Feb. 12, 2010," Appendix C, filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 4 pages.
"Response to the Office Action Dated Feb. 12, 2010," Appendix D, filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 9 pages.
"Response to the Office Action Dated Feb. 12, 2010," Appendix E, filed with the United States Patent and Trademark Office in connection with U.S. Appl. No. 95/000,514, corresponding to U.S. Pat. No. 7,376,993 issued from parent U.S. Appl. No. 10/725,071, Mar. 12, 2010, 12 pages.
"Third Party Inter Partes Reexamination Requestor's Comments Pursuant to 37 CFR § 1.947," filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 39 pages.
"Third Party Inter Partes Reexamination Requestor's Comments Pursuant to 37 CFR § 1.947," Exhibit Z, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 17 pages.
"Third Party Inter Partes Reexamination Requestor's Comments Pursuant to 37 CFR § 1.947," Exhibit AA, AA-1, filed with the United States Patent and Trademark Office in connection with U.S. Appl. No. 95/000,514, corresponding to U.S. Pat. No. 7,376,993 issued from parent U.S. Appl. No. 10/725,07, filed Oct. 18, 2010, 11 pages.
"Third Party Inter Partes Reexamination Requestor's Comments Pursuant to 37 CFR § 1.947," Exhibit AA, AA-2, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 2 pages.
"Third Party Inter Partes Reexamination Requestor's Comments Pursuant to 37 CFR § 1.947," Exhibit AA, AA-3, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-4, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 2 pages.
"Third Party Inter Partes Reexamination Requestor's Comments Pursuant to 37 CFR § 1.947," Exhibit AA, AA-5, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-6, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-7, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-8, filed with the United States Patent and Trademark Office in connection with U.S.

(56) References Cited

OTHER PUBLICATIONS

Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-9, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-10, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 6 pages.
"Third Party Inter Partes Reexamination Requestor's Comments Pursuant to 37 CFR § 1.947," Exhibit AA, AA-11, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-12, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 12 pages.
"Third Party Inter Partes Reexamination Requestor's Comments Pursuant to 37 CFR § 1.947," Exhibit AA, AA-13, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 5 pages.
"Third Party Inter Partes Reexamination Requestor's Comments Pursuant to 37 CFR § 1.947," Exhibit BB, filed with the United States Patent and Trademark Office in connection with U.S. Appl. No. 95/000,514, corresponding to U.S. Pat. No. 7,376,993 issued from parent U.S. Appl. No. 10/725,071, filed Oct. 18, 2010, 2 pages.
"Boppy 5-in-1," from Sensational Beginnings catalog, p. 43 (1 page).
"Gymini Deluxe—Black White Red," from http://www.babyuniverse.com/pro.asp?id=5268&rc=qDTeQF8fpnOZAnH80SY@&siteid=0041024721, May 2004 (1 page).
*Kolcraft Enterprises, Inc.* v. *Graco Children's Products, Inc. and Chicco USA, Inc.*, "Stipulation for Stay Proceedings Pending Outcome for Reexamination," filed with the United States District Court for the Northern District of Illinois, case No. 09-cv-03339, filed Dec. 3, 2009, 3 pages.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Dec. 10, 2009, 1 page.
"Defendant Chicco USA, Inc.'s Identification of Known Prior Art," filed with the United States District Court for the Northern District of Illinois on Dec. 21, 2009, 8 pages.
Graco, "Pack 'N Play Bassinet and Canopy," Owners Manual, 1999, 10 pages.
Graco, "Pack 'N Play," Owners Manual, 2000, 15 pages.
Graco, "Pack 'N Play," Owners Manual, 2001, 20 pages.
Graco, "Pack 'N Play," Owners Manual 2002, 44 pages.
Graco, "Pack 'N Play Canopy," Owners Manual, 2003, 8 pages.
Graco, "Pack 'N Play Playard," Owners Manual, Oct. 2003, 28 pages.
Graco, "Pack 'N Play Playard," Owners Manual, Dec. 2005, 36 pages.
"Request for Inter Partes Reexamination," Exhibit K, filed with the United States Patent and Trademark Office on Nov. 2, 2009, 12 pages.
"Request for Inter Partes Reexamination," Exhibit L, filed with the United States Patent and Trademark Office on Nov. 2, 2009, 6 pages.
"Request for Inter Partes Reexamination," Exhibit M, filed with the United States Patent and Trademark Office on Nov. 2, 2009, 1 page.
"Request for Inter Partes Reexamination," Exhibit N, filed with the United States Patent and Trademark Office on Nov. 2, 2009, 8 pages.
"Request for Inter Partes Reexamination," Exhibit O, filed with the United States Patent and Trademark Office on Nov. 2, 2009, 21 pages.
"Request for Inter Partes Reexamination," Exhibit P, filed with the United States Patent and Trademark Office on Nov. 2, 2009, 12 pages.
"Request for Inter Partes Reexamination," Exhibit Q, filed with the United States Patent and Trademark Office on Nov. 2, 2009, 14 pages.
"Request for Inter Partes Reexamination," Exhibit R, filed with the United States Patent and Trademark Office on Nov. 2, 2009, 7 pages.
"Request for Inter Partes Reexamination," Exhibit S, filed with the United States Patent and Trademark Office on Nov. 2, 2009, 16 pages.
"Request for Inter Partes Reexamination," Exhibit T, filed with the United States Patent and Trademark Office on Nov. 2, 2009, 15 pages.
"Request for Inter Partes Reexamination," Exhibit U, filed with the United States Patent and Trademark Office on Nov. 2, 2009, 8 pages.
"Request for Inter Partes Reexamination," Exhibit V, filed with the United States Patent and Trademark Office on Nov. 2, 2009, 7 pages.
"Request for Inter Partes Reexamination," Exhibit W, filed with the United States Patent and Trademark Office on Nov. 2, 2009, 3 pages.
"Request for Inter Partes Reexamination," Exhibit X, filed with the United States Patent and Trademark Office on Nov. 2, 2009, 4 pages.
The United States Patent and Trademark Office, "Notice of Allowance," issued in connection with U.S. Appl. No. 13/756,168, mailed on May 9, 2014, 16 pages.
The United States Patent and Trademark Office, "Notice of Allowance," issued in connection with U.S. Appl. No. 13/756,168, mailed on May 2, 2014, 6 pages.
The United States Patent and Trademark Office, "Notice of Allowance," issued in connection with U.S. Appl. No. 13/756,168, mailed on Apr. 30, 2014, 16 pages.
The United States Patent and Trademark Office, "Notice of Allowance," issued in connection with U.S. Appl. No. 13/756,168, mailed on Jan. 6, 2014, 22 pages.
The United States Patent and Trademark Office, "Non-Final Office Action," issued in connection with U.S. Appl. No. 13/756,168, mailed on May 23, 2013, 41 pages.
"Amendment and Request to Reopen Prosecution Pursuant to 37 CFR 41.77(b)(1)," filed with the United States Patent and Trademark Office on Jan. 9, 2014, in connection with reexamination control No. 95000514, corresponding to U.S. Pat. No. 7,376,993, 20 pages.
The United States Patent and Trademark Office, "Record of Oral Hearing, *Artsana USA* v. *Kolcraft Enterprises*," issued in connection with reexamination control No. 95000514, corresponding to U.S. Pat. No. 7,376,993, mailed Jan. 16, 2014, 38 pages.
The United States Patent and Trademark Office, "Order Remanding Inter Partes Reexamination Under 7 CFR 41.77(d) to the Examiner," issued in connection with reexamination control No. 95000514, corresponding to U.S. Pat. No. 7,376,993, mailed May 28, 2014, 4 pages.
The United States Patent and Trademark Office, "Determination after Board's Decision with New Grounds of Rejection," issued in connection with reexamination control No. 95000514, corresponding to U.S. Pat. No. 7,376,993, mailed Jul. 31, 2014, 22 pages.
Kids II, Inc., "Discovery Bug Play Gym Model 8972-2," Kids II archived web site retrieved from [URL: http://web.archive.org] on Oct. 1, 2014, archived Apr. 23, 2003, 3 pages.
Kids II, Inc., "Kids II Pooh Play Gym Model 37101-3," Kids II archived web site retrieved from [URL: http://web.archive.org] on Oct. 1, 2014, archived Apr. 23, 2003, 3 pages.
Artsana USA, Inc.'s "Final Invalidity and Unenforceability Contentions," *Kolcraft Enterprises, Inc.* v. *Artsana USA, Inc. et al.* Civil Action No. 1:13-cv-4863 (N.D. , III.), Aug. 27, 2014, 147 pages.

(56) References Cited

OTHER PUBLICATIONS

"Petition for Inter Parties Review of U.S. Pat. No. 8,388,501," with exhibits, filed with the United States Patent and Trademark Office on Jun. 27, 2014, 266 pages.
"Pack 'N Play Owners Manual," 386-11-01, Labeled "Artsana Exhibit 1004-1," Graco, 2001, 21 pages.
"Fold-n-Go Care Center Playyard with Bassinet/Changer Instruction Manual," PM-0728AA, Labeled "Artsana Exhibit 1005-1," Century, date unknown, 12 pages.
"Gymini 3-D Activity Gym," Labeled "Artsana Exhibit 1007-19," Undated, 4 pages.
"Merchandising," Labeled "Artsana Exhibit 1008-6," Feb. 1995, 3 pages.
Untitled, Labeled "Artsana Exhibit 1009-24," Undated, 1 page.
"Cousins Design," Labeled "Artsana Exhibit 1009-25," 1995, 6 pages.
Untitled, Labeled "Artsana Exhibit 1009-31," Undated, 11 pages.
The United States Patent and Trademark Office, "Litigation Search Report CRU 3999," issued in connection with reexamination control No. 95000514, corresponding to U.S. Pat. No. 7,376,993, dated Feb. 19, 2014, 33 pages.
"Petition for Inter Parties Review of U.S. Pat. No. 8,764,612," with exhibits, filed with the United States Patent and Trademark Office on Nov. 21, 2014, 185 pages.
"Cozy Quilt Gym," 52105, Labeled "Artsana Exhibit 1006-1," Tyco Playtime, 1995, 4 pages.
*Kolcraft Enterprises, Inc.* v. *Artsana USA, Inc. d/b/a Chicco USA. Inc.*, "Complaint for Patent Infringement," filed with the United States District Court for the Northern District of Illinois Eastern Division, case No. 1:14-CV-06561, filed Aug. 25, 2014, 5 pages.
United States Patent and Trademark Office, "Inter Partes Reexamination Office Action Closing Prosecution" issued in connection with reexamination control No. 95000514, mailed on Jul. 16, 2010, 59 pages.
United States Patent and Trademark Office, "Decision Dismissing Petition" issued in connection with reexamination control No. 95000514, mailed on Jul. 25, 2011, 6 pages.
United States Patent and Trademark Office, "Office communication concerning application control No. 95000514" mailed on Jul. 1, 2011, 2 pages.
United States Patent and Trademark Office, "Notice of Inter Partes Reexamination Request Filing Date" issued in connection with reexamination control No. 95000514, mailed on Jan. 15, 2010, 1 page.
United States Patent and Trademark Office, "Notice of Assignment of Inter Partes Reexamination Request" issued in connection with reexamination control No. 95000514, mailed on Jan. 15, 2010, 1 page.
United States Patent and Trademark Office, "Decision Dismissing Petition Under 37 C.F.R. 1.182" issued in connection with U.S. Pat. No. 7,376,993, mailed on Oct. 28, 2010, 6 pages.
United States Patent and Trademark Office, "Decision Granting Petition for Extension of Time [37 C.F.R. 1.956(c)]" issued in connection with U.S. Pat. No. 7,376,993, mailed Jul. 28, 2010, 3 pages.
United States Patent and Trademark Office, "Office communication concerning Inter Partes Examination" issued in connection with reexamination control No. 95000514, mailed on May 12, 2010, 2 pages.
"Corrected Third Party Inter Partes Reexamination Requester's Comments Pursuant to 37 CFR 1.947" filed with the United States Patent and Trademark Office on May 27, 2010 in connection with reexamination control No. 95000514, corresponding to U.S. Pat. No. 7,376,993, 52 pages.
"Corrected Third Party Inter Partes Reexamination Requester's Comments Pursuant to 37 CFR 1.947" filed with the United States Patent and Trademark Office on Jul. 18, 2011 in connection with reexamination control No. 95000514, corresponding to U.S. Pat. No. 7,376,993, 50 pages.
"Third Party Inter Partes Reexamination Requester's Emergency Petition Under 37 CFR 1.183 Requesting Waiver of the Page Limitation Requirement Under 37 CFR 1.943(8)" filed with the United States Patent and Trademark Office on Jul. 5, 2011 in connection with reexamination control No. 95000514, corresponding to U.S. Pat. No. 7,376,993, 117 pages.
"Third Party Inter Partes Reexamination Requester's Comments Pursuant to 37 CFR 1.947" filed with the United States Patent and Trademark Office on Feb. 23, 2011, in connection with reexamination control No. 95000514, corresponding to U.S. Pat. No. 7,376,993, 117 pages.
"Third Party Inter Partes Reexamination Requester's Comments Pursuant to 37 CFR 1.947" filed with the United States Patent and Trademark Office on Apr. 12, 2010, in connection with reexamination control No. 95000514, corresponding to U.S. Pat. No. 7,376,993, 65 pages.
"Response to the Office Action dated Jul. 16, 2010," filed with the United States Patent and Trademark Office on Sep. 16, 2010, in connection with reexamination control No. 95000514, corresponding to U.S. Pat. No. 7,376,993, 29 pages.
"Rule 131 Declaration of Edward Bretschger filed in the Response to the Office Action dated Jul. 16, 2010," filed with the United States Patent and Trademark Office on Sep. 16, 2010, in connection with reexamination control No. 95000514, corresponding to U.S. Pat. No. 7,376,993, 32 pages.
Response to Inter Party Reexamination Office action dated Dec. 22, 2010, filed with the United States Patent and Trademark Office on Jan. 24, 2011, in connection with U.S. Appl. No. 95/000,514, corresponding to U.S. Pat. No. 7,376,993, issued from parent U.S. Appl. No. 10/725,071, 22 pages.
United States Patent and Trademark Office Inter Party Reexamination Office action issued in connection with U.S. Appl. No. 95/000,514, corresponding to U.S. Pat. No. 7,376,993, issued from parent U.S. Appl. No. 10/725,071, mailed Dec. 22, 2010, 52 pages.
*Kolcraft Enterprises, Inc.* v. *Graco Children's Products, Inc. and Chicco USA, Inc.*, "Report on the Filing of Determination of an Action Regarding a Patent or Trademark," filed with the United States District Court, Northern District of Illinois, Eastern Division, on Apr. 6, 2012, Case:1:09-cv-03339, Document #:114, referencing reexamination control No. 95000514, corresponding to U.S. Pat. No. 7,376,993, 1 page.
*Kolcraft Enterprises, Inc.* v. *Graco Children's Products, Inc. and Chicco USA, Inc.*, "Statement," filed with the United States District Court, Northern District of Illinois, Eastern Division, on Apr. 5, 2012, Case:1:09-cv-03339, Document #:113, referencing reexamination control No. 95000514, corresponding to U.S. Pat. No. 7,376,993, 2 pages.
*Kolcraft Enterprises, Inc.* v. *Graco Children's Products, Inc. and Chicco USA, Inc.*, "Notice of Issuance of Right to Appeal Notice in Reexamination," filed with the United States District Court, Northern District of Illinois, Eastern Division, on Apr. 4, 2012, Case:1:09-cv-03339, Document #:111, referencing reexamination control No. 95000514, corresponding to U.S. Pat. No. 7,376,993, 2 pages.
*Kolcraft Enterprises, Inc.* v. *Graco Children's Products, Inc. and Chicco USA, Inc*, "Notice of Issuance of Right to Appeal Notice in Reexamination," Exhibit 1, filed with the United States District Court, Northern District of Illinois, Eastern Division, on Apr. 4, 2012, Case:1:09-cv-03339, Document #:111-1, referencing reexamination control No. 95000514, corresponding to U.S. Pat. No. 7,376,993, 51 pages.
*Kolcraft Enterprises, Inc.* v. *Graco Children's Products, Inc. and Chicco USA, Inc.*, "Revised Discovery Plan," filed with the United States District Court, Northern District of Illinois, Eastern Division, on Mar. 9, 2012, Case:1:09-cv-03339, Document #:97, referencing reexamination control No. 95000514, corresponding to U.S. Pat. No. 7,376,993, 6 pages.
*Kolcraft Enterprises, Inc.* v. *Graco Children's Products, Inc. and Chicco USA, Inc.*, "Notification of Docket Entry," issued by the United States District Court, Northern District of Illinois, Eastern Division, on Mar. 7, 2012, Case:1:09-cv-03339, Document #:96, referencing reexamination control No. 95000514, corresponding to U.S. Pat. No. 7,376,993, 1 page.

(56) References Cited

OTHER PUBLICATIONS

"Notice of Appeal to the Board of Patent Appeals and Interferences" filed with the United States Patent and Trademark Office on Apr. 18, 2012, in connection with reexamination control No. 95000514, corresponding to U.S. Pat. No. 7,376,993, 9 pages.
United States Patent and Trademark Office, "Right of Appeal Notice," issued in connection with reexamination control No. 95000514, corresponding to U.S. Pat. No. 7,376,993, mailed Mar. 21, 2012,50 pages.
"Appeal Brief of Third Party Requester Pursuant to 37 C.F.R. 41.67," filed with the United States Patent and Trademark Office on Jun. 15, 2012, in connection with reexamination control No. 95000514, corresponding to U.S. Pat. No. 7,376,993, 57 pages.
"Appeal Brief of Third Party Requester Pursuant to 37 C.F.R. 41.67," Exhibit 1, filed with the United States Patent and Trademark Office on Jun. 15, 2012, in connection with reexamination control No. 95000514, corresponding to U.S. Pat. No. 7,376,993, 13 pages.
"Appeal Brief of Third Party Requester Pursuant to 37 C.F.R. 41.67," Exhibit 2, filed with the United States Patent and Trademark Office on Jun. 15, 2012, in connection with reexamination control No. 95000514, corresponding to U.S. Pat. No. 7,376,993, 9 pages.
"Appeal Brief of Third Party Requester Pursuant to 37 C.F.R. 41.67," Exhibit 3, filed with the United States Patent and Trademark Office on Jun. 15, 2012, in connection with reexamination control No. 95000514, corresponding to U.S. Pat. No. 7,376,993, 4 pages.
"Appeal Brief of Third Party Requester Pursuant to 37 C.F.R. 41.67," Exhibit 4, filed with the United States Patent and Trademark Office on Jun. 15, 2012, in connection with reexamination control No. 95000514, corresponding to U.S. Pat. No. 7,376,993, 15 pages.
"Appeal Brief of Third Party Requester Pursuant to 37 C.F.R. 41.67," Exhibit 5, filed with the United States Patent and Trademark Office on Jun. 15, 2012, in connection with reexamination control No. 95000514, corresponding to U.S. Pat. No. 7,376,993, 26 pages.
"Appeal Brief of Third Party Requester Pursuant to 37 C.F.R. 41.67," Exhibit 6, filed with the United States Patent and Trademark Office on Jun. 15, 2012, in connection with reexamination control No. 95000514, corresponding to U.S. Pat. No. 7,376,993, 17 pages.
"Appeal Brief of Third Party Requester Pursuant to 37 C.F.R. 41.67," Exhibit 7, filed with the United States Patent and Trademark Office on Jun. 15, 2012, in connection with reexamination control No. 95000514, corresponding to U.S. Pat. No. 7,376,993, 8 pages.
"Appeal Brief of Third Party Requester Pursuant to 37 C.F.R. 41.67," Exhibit 8, filed with the United States Patent and Trademark Office on Jun. 15, 2012, in connection with reexamination control No. 95000514, corresponding to U.S. Pat. No. 7,376,993, 22 pages.
"Appeal Brief of Third Party Requester Pursuant to 37 C.F.R. 41.67," Exhibit 9, filed with the United States Patent and Trademark Office on Jun. 15, 2012, in connection with reexamination control No. 95000514, corresponding to U.S. Pat. No. 7,376,993, 13 pages.
"Appeal Brief of Third Party Requester Pursuant to 37 C.F.R. 41.67," Exhibit 10, filed with the United States Patent and Trademark Office on Jun. 15, 2012, in connection with reexamination control No. 95000514, corresponding to U.S. Pat. No. 7,376,993, 9 pages.
"Appeal Brief of Third Party Requester Pursuant to 37 C.F.R. 41.67," Exhibit 11, filed with the United States Patent and Trademark Office on Jun. 15, 2012, in connection with reexamination control No. 95000514, corresponding to U.S. Pat. No. 7,376,993, 8 pages.
"Appeal Brief of Third Party Requester Pursuant to 37 C.F.R. 41.67," Exhibit 12, filed with the United States Patent and Trademark Office on Jun. 15, 2012, in connection with reexamination control No. 95000514, corresponding to U.S. Pat. No. 7,376,993, 16 pages.
"Appeal Brief of Third Party Requester Pursuant to 37 C.F.R. 41.67," Exhibit 13, filed with the United States Patent and Trademark Office on Jun. 15, 2012, in connection with reexamination control No. 95000514, corresponding to U.S. Pat. No. 7,376,993, 8 pages.
"Replacement Request for Inter Partes Reexamination," filed with the United States Patent and Trademark Office on Jan. 8, 2010, 131 pages.
"Replacement Request for Inter Partes Reexamination," Exhibit A, filed with the United States Patent and Trademark Office on Jan. 8, 2010, 12 pages.
"Replacement Request for Inter Partes Reexamination," Exhibit B, filed with the United States Patent and Trademark Office on Jan. 8, 2010, 10 pages.
"Replacement Request for Inter Partes Reexamination," Exhibit C, filed with the United States Patent and Trademark Office on Jan. 8, 2010, 13 pages.
"Replacement Request for Inter Partes Reexamination," Exhibit D, filed with the United States Patent and Trademark Office on Jan. 8, 2010, 36 pages.
"Replacement Request for Inter Partes Reexamination," Exhibit E, filed with the United States Patent and Trademark Office on Jan. 8, 2010, 7 pages.
"Replacement Request for Inter Partes Reexamination," Exhibit F, filed with the United States Patent and Trademark Office on Jan. 8, 2010, 16 pages.
"Replacement Request for Inter Partes Reexamination," Exhibit G, filed with the United States Patent and Trademark Office on Jan. 8, 2010, 7 pages.
"Replacement Request for Inter Partes Reexamination," Exhibit H, filed with the United States Patent and Trademark Office on Jan. 8, 2010, 17 pages.
"Replacement Request for Inter Partes Reexamination," Exhibit I, filed with the United States Patent and Trademark Office on Jan. 8, 2010, 10 pages.
"Replacement Request for Inter Partes Reexamination," Exhibit J, filed with the United States Patent and Trademark Office on Jan. 8, 2010, 23 pages.
"Request for Ex Parte Reexamination of U.S. Pat. No. 8,388,501," with exhibits, filed with the United States Patent and Trademark Office dated Jul. 27, 2015, 175 pages.
The Patent Trial and Appeal Board of the United States Patent and Trademark Office, "New Decision Under 37 C.F.R. 41.77," issued in connection with reexamination Control No. 95000514, corresponding to U.S. Pat. No. 7,376,993, issued from U.S. Appl. No. 10/725,071, dated Dec. 7, 2015, 11 pages.
Fisher Price, "Instruction Sheet," Model No. 74067, 2002, 16 pages.
*Kolcraft Enterprises, Inc.* v. *Artsana USA, Inc. d/b/a Chicco USA. Inc. and Artsana, S.p.A. d/b/a Artsana Group*, "Plaintiff Kolcraft Enterprises, Inc.'s Motion to Lift Stay," filed with the United States District Court for the Northern District of Illinois Eastern Division, case No. 1:13-CV-04863, filed Sep. 19, 2016, 12 pages.
*Kolcraft Enterprises, Inc.* v. *Artsana USA, Inc. d/b/a Chicco USA. Inc. and Artsana, S.p.A. d/b/a Artsana Group*, "Defandant Artsana USA, Inc.'s Opposition to Kolcraft Enterprises, Inc.'s Renewed Motion to Lift Stay," filed with the United States District Court for the Northern District of Illinois Eastern Division, case No. 1:13-CV-04863, filed Sep. 21, 2016, 7 pages.
The United States Patent and Trademark Office, "Notice of Filing Date Accorded to Petition and Time for Filing Patent Owner Preliminary Response," issued in connection with Case No. IPR2014-01053, dated Jul. 8, 2014, 3 pages.
"Corrected Petition for Inter Parties Review of U.S. Pat. No. 8,388,501," filed with the United States Patent and Trademark Office in connection with Case No. IPR2014-01053 dated Jul. 11, 2014, 66 pages.
The United States Patent and Trademark Office, "Notice of Accepting Corrected Petition," issued in connection with Case No. IPR2014-01053, dated Jul. 16, 2014, 2 pages.
"Cozy Quilt Gym," 52105, Labeled "Artsana Exhibit 1007-22," Tyco Playtime, Undated, filed in connection with Petition for Inter Parties Review of U.S. Pat. No. 8,388,501 dated Jun. 27, 2014, 1 page.
The American Heritage College Dictionary, "Couple," Labeled "Artsana Exhibit 1013-1," 1993, p. 318, filed in connection with Corrected Petition for Inter Parties Review of U.S. Pat. No. 8,388,501 dated Jul. 11, 2014, 3 pages.

(56) References Cited

OTHER PUBLICATIONS

Webster's Encyclopedic Unabridged Dictionary of the English Language, "Couple," Labeled "Artsana Exhibit 1014-1," 1994, p. 334, filed in connection with Corrected Petition for Inter Parties Review of U.S. Pat. No. 8,388,501 dated Jul. 11, 2014, 3 pages.
The United States Patent and Trademark Office, "Litigation Search Report CRU 3999," issued in connection with reexamination control No. 90013554, corresponding to U.S. Pat. No. 8,388,501, dated Jul. 30, 2015, 33 pages.
The United States Patent and Trademark Office, "Order Granting Request for Ex Parte Reexamination," issued in connection with reexamination control No. 90013554, dated Sep. 2, 2015, 15 pages.
The United States Patent and Trademark Office, "Litigation Search Report CRU 3999," issued in connection with reexamination control No. 90013554, corresponding to U.S. Pat. No. 8,388,501, dated Apr. 5, 2016, 33 pages.
The United States Patent and Trademark Office, "Decision, Institution of Inter Partes Review 37 C.F.R. 42.108," issued in connection with Case No. IPR2015-00286, entered May 29, 2015, 16 pages.
The United States Patent and Trademark Office, "Judgment: Termination of the Proceeding," issued in connection with Case No. IPR2015-00286, entered Jun. 25, 2015, 3 pages.
*Kolcraft Enterprises, Inc.* v. *Chicco USA, Inc. d/b/a Artsana USA, Inc.* , "Kolcraft's Motion for Leave to File Supplemental Claim Construction Authority," filed with the United States District Court for the Northern District of Illinois Eastern Division, case No. 1:09-CV-03339, filed Nov. 7, 2014, 14 pages.
*Kolcraft Enterprises, Inc.* v. *Artsana USA, Inc. d/b/a Chicco USA. Inc. and Artsana, S.p.A. d/b/a Artsana Group*, "Defendant Artsana USA Inc.'s Answer, Affirmative Defenses, and Counterclaims to Complaint," filed with the United States District Court for the Northern District of Illinois Eastern Division, case No. 1:13-CV-04863, filed Sep. 3, 2013, 11 pages.
*Kolcraft Enterprises, Inc.* v. *Artsana USA, Inc. d/b/a Chicco USA. Inc. and Artsana, S.p.A. d/b/a Artsana Group*, "Kolcraft's Response to Artsana USA's Counterclaims," filed with the United States District Court for the Northern District of Illinois Eastern Division, case No. 1:13-CV-04863, filed Sep. 20, 2013, 8 pages.
*Kolcraft Enterprises, Inc.* v. *Artsana USA, Inc. d/b/a Chicco USA. Inc. and Artsana, S.p.A. d/b/a Artsana Group*,"Defendant Artsana USA, Inc.'s Amended Counterclaims," filed with the United States District Court for the Northern District of Illinois Eastern Division, case No. 1:13-CV-04863, filed May 7, 2015, 6 pages.
*Kolcraft Enterprises, Inc.* v. *Artsana USA, Inc. d/b/a Chicco USA. Inc. and Artsana, S.p.A. d/b/a Artsana Group*, "Answer to Artsana USA, Inc.'s Amended Counterclaims," filed with the United States District Court for the Northern District of Illinois Eastern Division, case No. 1:13-CV-04863, filed May 12, 2015, 53 pages.
*Kolcraft Enterprises, Inc.* v. *Artsana USA, Inc.*, "Defendant Artsana USA, Inc.'s Answer to Complaint, Affirmative Defenses, and Counterclaims," filed with the United States District Court for the Northern District of Illinois Eastern Division, case No. 1:14-CV-06561, filed Sep. 18, 2014, 11 pages.
*Kolcraft Enterprises, Inc.* v. *Artsana USA, Inc.*, "Plaintiff's Response to Defendant Counterclaims," filed with the United States District Court for the Northern District of Illinois Eastern Division, case No. 1:14-CV-06561, filed Oct. 7, 2014, 9 pages.
*Kolcraft Enterprises, Inc.* v. *Artsana USA, Inc.*, "Notification of Docket Entry," entered by the United States District Court for the Northern District of Illinois Eastern Division, case No. 1:14-CV-06561, entered Sep. 24, 2015, 1 page.
"Patent Owner's Mandatory Notices," filed with the United States Patent and Trademark Office in connection with Case No. IPR2014-001053 dated Jul. 16, 2014, 3 pages.
"Patent Owner's Mandatory Notices," filed with the United States Patent and Trademark Office in connection with Case No. IPR22015-00582 dated Feb. 4, 2015, 4 pages.
"Patent Owner's Mandatory Notices," filed with the United States Patent and Trademark Office in connection with Case No. IPR22015-00286 dated Dec. 18, 2014, 3 pages.
The United States Patent and Trademark Office, "Decision on Request for Rehearing," issued in connection with reexamination control No. 95/000,514, dated Aug. 8, 2016, 12 pages.
"Second Petition for Inter Partes Review of U.S. Pat. No. 8,388,501," with exhibits, filed with the United States Patent and Trademark Office dated Jan. 20, 2015, 197 pages.
United States Patent and Trademark Office, "Non-Final Office Action," issued in connection with U.S. Appl. No. 90/013,554, dated Apr. 26, 2016, 40 pages.
The United States Patent and Trademark Office, "Decision Denying Inter Partes Review, Denying Motion for Joinder," issued in connection with Case No. IPR2015-00582, entered Jun. 4, 2015, 6 pages.
The United States Patent and Trademark Office, "Final Office action," issued in connection with reexamination control No. 90/013,554, dated Sep. 2, 2016, 7 pages.
*Kolcraft Enterprises, Inc.* v. *Chicco USA, Inc. d/b/a Artsana USA, Inc.*, "Memorandum Opinion and Order," United States District Court for the Northern District of Illinois Eastern Division, case No. 1:09-CV-03339, entered Sep. 2, 2016, 34 pages.
*Kolcraft Enterprises, Inc.* v. *Chicco USA, Inc. d/b/a Artsana USA, Inc.*, "Defendant's Artsana USA Inc.'s Motion for Leave to Amend Its Final Invalidity Contentions," filed with the United States District Court for the Northern District of Illinois Eastern Division, case No. 1:13-CV-04863, filed Jun. 2, 2017, 2 pages.
*Kolcraft Enterprises, Inc.* v. *Chicco USA, Inc. d/b/a Artsana USA, Inc.*, "Artsana USA, Inc.'s Memorandum of Law in Support of its Motion for Leave to Amend Its Final Invalidity Contentions Pursuant to Local Patent Rule 3.4," filed with the United States District Court for the Northern District of Illinois Eastern Division, case No. 1:13-CV-04863, filed Jun. 2, 2017, 427 pages (includes exhibits).
*Kolcraft Enterprises, Inc.* v. *Chicco USA, Inc. d/b/a Artsana USA, Inc.*, "Defendant's Artsana USA Inc.'s Motion for Leave to Amend Its Final Invalidity Contentions," filed with the United States District Court for the Northem District of Illinois Eastern Division, case No. 1:13-CV-04863, filed Jun. 2, 2017, 2 pages.
*Kolcraft Enterprises, Inc.* v. *Chicco USA, Inc. d/b/a Artsana USA, Inc.*, "Artsana USA, Inc.'s Memorandum of Law in Support of Its Motion for Leave to Amend Its Final Invalidity Contentions Pursuant to Local Patent Rule 3.4," filed with the United States District Court for the Northern District of Illinois Eastern Division, case No. 1:13-CV-04863, filed Jun. 2, 2017, 215 pages (includes exhibits).
*Kolcraft Enterprises, Inc.* v. *Chicco USA, Inc. d/b/a Artsana USA, Inc.*, "Plaintiff's Opposition to Defendant's Motion for Leave to Amend Its Final Invalidity Contentions," filed with the United States District Court for the Northern District of Illinois Eastern Division, case No. 1:13-CV-04863, filed Jun. 22, 2017, 81 pages (includes exhibits).
*Kolcraft Enterprises, Inc.* v. *Chicco USA, Inc. d/b/a Artsana USA, Inc.*, "Defendant's Artsana USA Inc.'s Motion for Leave to Amend Its Final Invalidity Contentions," filed with the United States District Court for the Northern District of Illinois Eastern Division, case No. 1:09-CV-03339, filed Jun. 2, 2017, 2 pages.
*Kolcraft Enterprises, Inc.* v. *Chicco USA, Inc. d/b/a Artsana USA, Inc.*, "Artsana USA, Inc.'s Memorandum of Law in Support of Its Motion for Leave to Amend Its Final Invalidity Contentions Pursuant to Local Patent Rule 3.4," filed with the United States District Court for the Northern District of Illinois Eastern Division, case No. 1:09-CV-03339, filed Jun. 5, 2017, 215 pages (includes exhibits).
*Kolcraft Enterprises, Inc.* v. *Chicco USA, Inc. d/b/a Artsana USA, Inc.*, "Plaintiff's Opposition to Defendant's Motion for Leave to Amend Its Final Invalidity Contentions," filed with the United States District Court for the Northern District of Illinois Eastern Division, case No. 1:09-CV-03339, filed Jun. 19, 2017, 80 pages (includes exhibits).
*Kolcraft Enterprises, Inc.* v. *Chicco USA, Inc. d/b/a Artsana USA, Inc.*, "Artsana USA, Inc.'s Reply Brief in Support of Its' Motion for Leave to Amend Final Invalidity Contentions Pursuant to Local Patent Rule 3.4," filed with the United States District Court for the

(56) References Cited

OTHER PUBLICATIONS

Northern District of Illinois Eastern Division, case No. 1:09-CV-03339, filed Jun. 23, 2017, 48 pages (includes exhibits).
*Kolcraft Enterprises, Inc.* v. *Chicco USA, Inc. d/b/a Artsana USA, Inc.*, "Plaintiff's Responsive Claim Construction Brief" and accompanying exhibits filed with United States District Court for the Northern District of Illinois Eastern Division, case No. 1:09-Cv-03339, filed Jan. 23, 2017, 106 pages (includes exhibits).
*Kolcraft Enterprises, Inc.* v. *Chicco USA, Inc. d/b/a Artsana USA, Inc.*, "Defendant's Reply Brief in Support of the Terms of Reexamined Claim 20 of U.S. Pat. No. 7,376,993 that Require Construction" and accompanying exhibits filed with United States District Court for the Northern District of Illinois Eastern Division, case No. 1:09-CV-03339, filed Jan. 30, 2017, 35 pages (includes exhibits).
*Kolcraft Enterprises, Inc.* v. *Chicco USA, Inc. d/b/a Artsana USA, Inc.*, "Defendant's Brief in Support of the Terms of U.S. Pat. No. 8,388,501 that Require Construction," filed with the United States District Court for the Northern District of Illinois Eastern Division, case No. 1:13-CV-04863, filed Feb. 17, 2017, 152 pages (includes exhibits).
*Kolcraft Enterprises, Inc.* v. *Chicco USA, Inc. d/b/a Artsana USA, Inc.*, "Plaintiff's Responsive Claim Construction Brief," filed with the United States District Court for the Northern District of Illinois Eastern Division, case No. 1:13-CV-04863, filed Mar. 17, 2017, 115 pages (includes exhibits).
*Kolcraft Enterprises, Inc.* v. *Chicco USA, Inc. d/b/a Artsana USA, Inc.*, "Defendant's Reply Brief in Support of the Terms of U.S. Pat. No. 8,388,501 that Require Construction," filed with the United States District Court for the Northern District of Illinois Eastern Division, case No. 1:13-CV-04863, filed Mar. 31, 2017, 20 pages.
*Kolcraft Enterprises, Inc.* v. *Chicco USA, Inc. d/b/a Artsana USA, Inc.*, "Joint Claim Construction Chart and Status Report," filed with the United States District Court for the Northern District of Illinois Eastern Division, case No. 1:13-CV-04863, filed Apr. 7, 2017, 6 pages.
*Kolcraft Enterprises, Inc.* v. *Chicco USA, Inc. d/b/a Artsana USA, Inc.*, "Joint Appendix Pursuant to LPR 4.2(b)," filed with the United States District Court for the Northern District of Illinois Eastern Division, case No. 1:13-CV-04863, filed Feb. 17, 2017, Part 1: pp. 1-400.
*Kolcraft Enterprises, Inc.* v. *Chicco USA, Inc. d/b/a Artsana USA, Inc.*, "Joint Appendix Pursuant to LPR 4.2(b)," filed with the United States District Court for the Northern District of Illinois Eastern Division, case No. 1:13-CV-04863, filed Feb. 17, 2017, Part 2; pp. 401-701.
*Kolcraft Enterprises, Inc.* v. *Chicco USA, Inc. d/b/a Artsana USA, Inc.*, "Joint Appendix Pursuant to LPR 4.2(b)," filed with the United States District Court for the Northern District of Illinois Eastern Division, case No. 1:13-CV-04863, filed Feb. 17, 2017, Part 3: pp. 702-1023.
*Kolcraft Enterprises, Inc.* v. *Chicco USA, Inc. d/b/a Artsana USA, Inc.*, "Joint Appendix Pursuant to LPR 4.2(b)," filed with the United States District Court for the Northern District of Illinois Eastern Division, case No. 1:13-CV-04863, filed Feb. 17, 2017, Part 4: pp. 1024-1389.
*Kolcraft Enterprises, Inc.* v. *Chicco USA, Inc. d/b/a Artsana USA, Inc.*, "Joint Appendix Pursuant to LPR 4.2(b)," filed with the United States District Court for the Northern District of Illinois Eastern Division, case No. 1:13-CV-04863, filed Feb. 17, 2017, Part 5: pp. 1390-1597.
The United States Patent and Trademark Office, "Notice of Intent to Issue Inter Partes Reexamination Certification," issued in connection with reexamination control No. 95/000,514, dated Mar. 15, 2017, 46 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:13-CV-04863, entered Sep. 20, 2017, 2 pages.
*Kolcraft Enterprises, Inc.* v. *Chicco USA, Inc. d/b/a Artsana USA, Inc.*, "Artsana's Motion for Reconsideration of the Court's Sep. 20, 2017 Order Denying Defendant's Motion for Leave to Amend Its Final Invalidity Contentions," filed with the United States District Court for the Northern District of Illinois Eastern Division, case No. 1:13-CV-04863, filed Oct. 4, 2017, 9 pages.
The United States Patent and Trademark Office, "Litigation Search Report CRU 3999," issued in connection with reexamination control No. 90013554, corresponding to U.S. Pat. No. 8,388,501, dated Nov. 8, 2017, 34 pages.
*Kolcraft Enterprises, Inc.* v. *Chicco USA, Inc. d/b/a Artsana USA, Inc.*, "Notificaton of Docket Entry," issued by the United States District Court for the Northern District of Illinois Eastern Division, case No. 1:13-CV-04863, entered Oct. 19, 2017, 1 page.
*Kolcraft Enterprises, Inc.* v. *Chicco USA, Inc. d/b/a Artsana USA, Inc.*, "Opinion and Order," issued by the United States District Court for the Northern District of Illinois Eastern Division, case No. 1:13-CV-04863, entered Nov. 14, 2017, 16 pages.
*Kolcraft Enterprises, Inc.* v. *Chicco USA, Inc. d/b/a Artsana USA, Inc.*, "Material from Internet cited in Opinion and Order dated Nov. 14, 2017," issued by the United States District Court for the Northern District of Illinois Eastern Division, case No. 1:13-CV-04863, entered Nov. 16, 2017, 4 pages.
*Kolcraft Enterprises, Inc.* v. *Chicco USA, Inc. d/b/a Artsana USA, Inc.*, "Artsana USA, Inc.'s Reply Brief in Support of Its Motions for Leave to Amend Its Final Invalidity Contentions Pursuant to Local Patent Rule 3.4," filed with the United States District Court for the Northern District of Illinois Eastern Division, case No. 1:13-CV-04863, filed Jun. 29, 2017, 72 pages (includes exhibits).
*Kolcraft Enterprises, Inc.* v. *Chicco USA, Inc. d/b/a Artsana USA, Inc.*, "Notice of Filing," filed with the United States District Court for the Northern District of Illinois Eastern Division, case No. 1:13-CV-04863, filed Jul. 10, 2017, 4 pages (includes exhibit).
*Kolcraft Enterprises, Inc.* v. *Chicco USA, Inc. d/b/a Artsana USA, Inc.*, "Notification of Docket Entry," entered by the United States District Court for the Northern District of Illinois Eastern Division, case No. 1:09-CV-03339, entered Jul. 9, 2017, 1 page.
*Kolcraft Enterprises, Inc.* v. *Chicco USA, Inc. d/b/a Artsana USA, Inc.*, "Artsana USA, Inc.'s Motion for Clarification of the Jul. 9, 2017 Minute Order (Dkt. No. 261)," filed with the United States District Court for the Northern District of Illinois Eastern Division, case No. 1:09-CV-03339, filed Jul. 27, 2017, 11 pages (includes exhibit).
*Kolcraft Enterprises, Inc.* v. *Chicco USA, Inc. d/b/a Artsana USA, Inc.*, "Artsana USA, Inc.'s Amended Motion for Clarification of the Jul. 9, 2017 Minute Order (Dkt. No. 261)," filed with the United States District Court for be Northern District of Illinois Eastern Division, case No. 1:09-CV-03339, filed Aug. 4, 2017, 11 pages (includes exhibit).
*Kolcraft Enterprises, Inc.* v. *Chicco USA, Inc. d/b/a Artsana USA, Inc.*, "Plaintiff's Opposition to Defendant's Amended Motion for Clarification of the Jul. 9, 2017 Minute Order," filed with the United States District Court for the Northern District of Illinois Eastern Division, case No. 1:09-CV-03339, filed Aug. 7, 2017, 9 pages (includes exhibit).
*Kolcraft Enterprises, Inc.* v. *Chicco USA, Inc. d/b/a Artsana USA, Inc.*, "Notification of Docket Entry," entered by the United States District Court for the Northern District of Illinois Eastern Division, case No. 1:09-CV-03339, entered Aug. 8, 2017, 1 page.
Mattel & Fischer-Price Customer Service, "Learning Patterns Motion & Music Jungle Gym," available at http://service.mattel.com/us/product_detail.asp?id=74067&Ntt=74067&Pn=1&Brand=Fisher-Price+Infant+Toys&Cat=Other+Fisher-Price+Infant+ Toys (last accessed Sep. 28, 2016), 2 pages.
*Kolcraft Enterprises, Inc.* v. *Chicco USA, Inc. d/b/a Artsana USA, Inc.*, "Memorandum Opinion and Order" entered by the United States District Court for the Northern District of Illinois Eastern Division, case No. 1:09-CV-03339, entered Apr. 13, 2018, 12 pages.
The United States Patent and Trademark Office, "Notice of Intent to Issue Ex Parte Reexamination Certificate," issued in connection with reexamination control No. 90/013,554, corresponding to U.S. Pat. No. 8,388,501, dated Dec. 13, 2017, 25 pages.
The United States Patent and Trademark Office, "Notice of Reexamination Request Filing date," issued in connection with reexami-

(56) References Cited

OTHER PUBLICATIONS nation control No. 90/014,062, corresponding to U.S. Pat. No. 7,376,993, dated Jan. 18, 2018, 1 page.
The United States Patent and Trademark Office, "Notice of Assignment of Reexamination Request" issued in connection with reexamination control No. 90/014,062, corresponding to U.S. Pat. No. 7,376,993, dated Jan. 18, 2018,1 page.
The United States Patent and Trademark Office, "Order Granting Request for Ex Parte Reexamination," issued in connection with reexamination control No. 90/014,062, corresponding to U.S. Pat. No. 7,376,993, dated Feb. 20, 2018, 16 pages.
The United States Patent and Trademark Office, "Litigation Search Report CRU 3999," issued in connection with reexamination control No. 90/014,062, corresponding to U.S. Pat. No. 7,376,993, dated Jan. 11, 2018, 102 pages.
The United States Patent and Trademark Office, "Non-Final Office action," issued in connection with reexamination control No. 90/014,062, corresponding to U.S. Pat. No. 7,376,993, dated May 14, 2018, 10 pages.
*Kolcraft Enterprises, Inc.* v. *Chicco USA, Inc. d/b/a Artsana USA, Inc.*, "Defendant Artsana's USA Inc's Motion for Leave to File Its Motion for Summary Judgment," filed with the United States District Court for the Northern District of Illinois Eastern Division, case No. 1:09-CV-03339, filed Aug. 6, 2018, 2 pages.
*Kolcraft Enterprises, Inc.* v. *Chicco USA, Inc. d/b/a Artsana USA, Inc.*, "Defendant Artsana's USA Inc's Motion for Summary Judgment that Kolcraft Has Not Satisfied Its Burden of Proving Reasonable Royalty Damages," filed with the United States District Court for the Northern District of Illinois Eastern Division, case No. 1:09-CV-03339, filed Aug. 6, 2018, 2 pages.
*Kolcraft Enterprises, Inc.* v. *Chicco USA, Inc. d/b/a Artsana USA, Inc.*, "Defendant Artsana's USA Inc's Memorandum in Support of Its Motion for Summary Judgment that Kolcraft Has Not Satisfied Its Burden of Proving Reasonable Royalty Damages," filed with the United States District Court for the Northern District of Illinois Eastern Division, case No. 1:09-CV-03339, filed Aug. 6, 2018, 18 pages.
*Kolcraft Enterprises, Inc.* v. *Chicco USA, Inc. d/b/a Artsana USA, Inc.*, "Defendant Artsana's USA Inc's Statement of Material Facts in Support of Its Motion for Summary Judgment that Kolcraft Has Not Satisfied Its Burden of Proving Reasonable Royalty Damages," filed with the United States District Court for the Northern District of Ilinois Eastern Division, case No. 1:09-CV-03339, filed Aug. 6, 2018, 39 pages.
*Kolcraft Enterprises, Inc.* v. *Chicco USA, Inc. d/b/a Artsana USA, Inc.*, "Kolcraft's Opposition to Artsana's Motion for Leave to File a Summary Judgment Motion on Damages," filed with the United States District Court for the Northern District of Illinois Eastern Division, case No. 1:09-CV-03339, filed Aug. 7, 2018, 23 pages.
*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:09-CV-03339, entered Aug. 7, 2018, 1 page.
*Kolcraft Enterprises, Inc.* v. *Chicco USA, Inc. d/b/a Artsana USA, Inc.*, "Defendant Artsana USA, Inc.'s Supplemental Brief in Support of Motion in Limine No. 6 to Exclude the Supplemental Expert Report and Testimony of Frank A. Bernatowicz on Reasonable Royalty Damages (ECF 357-358)," filed with the United States District Court for the Northern District of Illinois Eastern Division, case No. 1:09-CV-03339, filed Aug. 9, 2018, 20 pages.
*Kolcraft Enterprises, Inc.* v. *Chicco USA, Inc. d/b/a Artsana USA, Inc.*, "Plaintiff's Response to Defendant's Motion in Limine No. 6 to Exclude the Supplemental Expert Report and Testimony of Frank A. Bernatowicz on Reasonably Royalty Damages (Dkt. #357-358, 381)," filed with the United States District Court for the Northern District of Illinois Eastern Division, case No. 1:09-CV-03339, filed Aug. 14, 2018, 14 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:09-CV-03339, entered Aug. 16, 2018, 6 pages.
"Response to Office action," filed with the United States Patent and Trademark Office in connection with reexamination control No. 90/014,062, corresponding to U.S. Pat. No. 7,376,993, filed Aug. 14, 2018, 222 pages.(Submitted as 2 parts).
*Kolcraft Enterprises, Inc.* v. *Chicco USA, Inc. d/b/a Artsana USA, Inc.*, "Defendant's Motion for Summary Judgment of (1) Non-Infringement, (2) No Willful Infringement, (3) No Pre-Filing Damages, (4) No Damages on Claims 28-31, and (5) Invalidity for Improper Inventorship," filed with the United States District Court for the Northern District of Illinois Eastern Division, case No. 1:09-CV-03339, filed Jun. 1, 2018, 2 pages.
*Kolcraft Enterprises, Inc.* v. *Chicco USA, Inc. d/b/a Artsana USA, Inc.*, "Defendant's Memorandum in Support of its Motion for Summary Judgment of (1) Non-Infringement, (2) No Willful Infringement, (3) No Pre-Filing Damages, (4) No Damages on Claims 28-31, and (5) Invalidity for Improper Inventorship," filed with the United States District Court for the Northern District of Illinois Eastern Division, case No. 1:09-CV-03339, filed Jun. 1, 2018, 29 pages.
*Kolcraft Enterprises, Inc.* v. *Chicco USA, Inc. d/b/a Artsana USA, Inc.*, "Defendant Artsana USA, Inc.'s Motions in Limine: No. 1 to Exclude the Expert Report and Testimony of Frank A. Bernatowicz on Reasonable Royalty Damages; and No. 2 to Exclude the Expert Report and Testimony of Nicholas P. Godici on Prosecution History," filed with the United States District Court for the Northern District of Illinois Eastern Division, case No. 1:09-CV-03339, filed Jun. 20, 2018, 2 pages.
*Kolcraft Enterprises, Inc.* v. *Chicco USA, Inc. d/b/a Artsana USA, Inc.*, "Defendant Artsana USA, Inc.'s Memorandum in Support of Motions in Limine: No. 1 to Exclude the Expert Report and Testimony of Frank A. Bernatowicz on Reasonable Royalty Damages; and No. 2 to Exclude the Expert Report and Testimony of Nicholas P. Godici on Prosecution History," filed with the United States District Court for the Northern District of Illinois Eastern Division, case No. 1:09-CV-03339, filed Jun. 20, 2018, 279 pages.
*Kolcraft Enterprises, Inc.* v. *Chicco USA, Inc. d/b/a Artsana USA, Inc.*, "Defendant Artsana USA, Inc.'s Motions in Limine: No. 3 to Preclude Kolcraft from Asserting Infringement Under the Doctrine of Equivalents; No. 4 to Preclude Kolcraft from Making Certain Statements at Trial; and No. 5 to Limit Deposition Testimony of Tiffany Manzella and Edward Bretschger at Trial," filed with the United States District Court for the Northern District of Illinois Eastern Division, case No. 1:09-CV-03339, filed Jun. 20, 2018, 2 pages.
*Kolcraft Enterprises, Inc.* v. *Chicco USA, Inc. d/b/a Artsana USA, Inc.*, "Defendant Artsana USA, Inc.'s Memorandum of Law in Support of Motions in Limine: No. 3 to Preclude Kolcraft from Asserting Infringement Under the Doctrine of Equivalents; No. 4 to Preclude Kolcraft from Making Certain Statements at Trial; and No. 5 to Limit Deposition Testimony of Tiffany Manzella and Edward Bretschger at Trial," filed with the United States District Court for the Northern District of Illinois Eastern Division, case No. 1:09-CV-03339, filed Jun. 20, 2018, 97 pages.
*Kolcraft Enterprises, Inc.* v. *Chicco USA, Inc. d/b/a Artsana USA, Inc.*, "Proposed Pretrial Order," issued by the United States District Court for the Northern District of Illinois Eastern Division, case No. 1:09-CV-03339, entered Jun. 20, 2018, 228 pages.
*Kolcraft Enterprises, Inc.* v. *Chicco USA, Inc. d/b/a Artsana USA, Inc.*, "Plaintiff's Motion in Limine to Exclude Evidence of the Pending Ex Parte Reexamination," filed with the United States District Court for the Northern District of Illinois Eastern Division, case No. 1:09-CV-03339, filed Jun. 20, 2018, 5 pages.
*Kolcraft Enterprises, Inc.* v. *Chicco USA, Inc. d/b/a Artsana USA, Inc.*, "Plaintiff's Motion in Limine to Exclude Testimony of Albert Ferrigno," filed with the United States District Court for the Northern District of Illinois Eastern Division, case No. 1:09-CV-03339, filed Jun. 20, 2018, 4 pages.
*Kolcraft Enterprises, Inc.* v. *Chicco USA, Inc. d/b/a Artsana USA, Inc.*, "Plaintiff's Motion in Limine to Preclude Reference to Unasserted Patent and Patent Claims," filed with the United States

(56) References Cited

OTHER PUBLICATIONS

District Court for the Northern District of Illinois Eastern Division, case No. 1:09-CV-03339, filed Jun. 20, 2018, 5 pages.
*Kolcraft Enterprises, Inc.* v. *Chicco USA, Inc. d/b/a Artsana USA, Inc.*, "Plaintiff's Motion in Limine to Preclude Reference to Plaintiff's Voluntary Recall of its Playards or Injuries Therefrom," filed with the United States District Court for the Northern District of Illinois Eastern Division, case No. 1:09-CV-03339, filed Jun. 20, 2018, 4 pages.
*Kolcraft Enterprises, Inc.* v. *Chicco USA, Inc. d/b/a Artsana USA, Inc.*, "Amended Proposed Pretrial Order," issued by the United States District Court for the Northern District of Illinois Eastern Division, case No. 1:09-CV-03339, entered Jun. 22, 2018, 229 pages.
*Kolcraft Enterprises, Inc.* v. *Chicco USA, Inc. d/b/a Artsana USA, Inc.*, "Plaintiff's Opposition to Defendant's Motion for Summary Judgment of: (1) Non-Infringement, (2) No Willful Infringement, (3) No Pre-Filing Damages, (4) No Damages on Claims 28-31, and (5) Invalidity for Improper Inventorship (DKT. #298)," filed with the United States District Court for the Northern District of Illinois Eastern Division, case No. 1:09-CV-03339, filed Jun. 22, 2018, 29 pages.
*Kolcraft Enterprises, Inc.* v. *Chicco USA, Inc. d/b/a Artsana USA, Inc.*, "Plaintiff's Local Rule 56.1 Response and Statement of Additional Facts," filed with the United States District Court for the Northern District of Illinois Eastern Division, case No. 1:09-CV-03339, filed Jun. 23, 2018, 146 pages.
*Kolcraft Enterprises, Inc.* v. *Chicco USA, Inc. d/b/a Artsana USA, Inc.*, "Plaintiff's Response to Defendant's Motion in Limine No. 1 to Exclude the Expert Report and Testimony of Frank A. Bernatowicz on Reasonable Royalty Damages (DKT. #304)," filed with the United States District Court for the Northern District of Illinois Eastern Division, case No. 1:09-CV-03339, filed Jul. 2, 2018, 25 pages.
*Kolcraft Enterprises, Inc.* v. *Chicco USA, Inc. d/b/a Artsana USA, Inc.*, "Defendant Artsana USA, Inc.'s Consolidated Opposition to Plaintiff's Motions in Limine (ECF Nos. 310-313)," filed with the United States District Court for the Northern District of Illinois Eastern Division, case No. 1:09-CV-03339, filed Jul. 2, 2018, 188 pages.
*Kolcraft Enterprises, Inc.* v. *Chicco USA, Inc. d/b/a Artsana USA, Inc.*, "Plaintiff's Response to Defendant's Motion in Limine Nos. 3-5 (DKT. #307)," filed with the United States District Court for the Northern District of Illinois Eastern Division, case No. 1:09-CV-03339, filed Jul. 2, 2018, 28 pages.
*Kolcraft Enterprises, Inc.* v. *Chicco USA, Inc. d/b/a Artsana USA, Inc.*, "Plaintiff's Response to Defendant's Motion in Limine No. 2 to Exclude the Expert Report and Testimony of Nicholas P. Godici on Prosecution History," filed with the United States District Court for the Northern District of Illinois Eastern Division, case No. 1:09-CV-03339, filed Jul. 2, 2018, 15 pages.
*Kolcraft Enterprises, Inc.* v. *Chicco USA, Inc. d/b/a Artsana USA, Inc.*, "Reply in Support of Plaintiff's Motion in Limine to Preclude Reference to Plaintiff's Voluntary Recall of its Playards or Injuries Therefrom (DKT. #313)," filed with the United States District Court for the Northern District of Illinois Eastern Division, case No. 1:09-CV-03339, filed Jul. 3, 2018, 17 pages.
*Kolcraft Enterprises, Inc.* v. *Chicco USA, Inc. d/b/a Artsana USA, Inc.*, "Reply in Support of Plaintiff's Motion in Limine to Exclude Evidence of the Pending Ex Parte Reexamination (DKT. #310)," filed with the United States District Court for the Northern District of Illinois Eastern Division, case No. 1:09-CV-03339, filed Jul. 3, 2018, 7 pages.
*Kolcraft Enterprises, Inc.* v. *Chicco USA, Inc. d/b/a Artsana USA, Inc.*, "Defendant's Reply Brief in Support of Motion for Summary Judgment of: (1) Non-Infringement, (2) No Willful Infringement, (3) No Pre-Filing Damages, (4) No Damages on Claims 28-31, and (5) Invalidity for Improper Inventorship," filed with the United States District Court for the Northern District of Illinois Eastern Division, case No. 1:09-CV-03339, filed Jul. 3, 2018, 21 pages.
*Kolcraft Enterprises, Inc.* v. *Chicco USA, Inc. d/b/a Artsana USA, Inc.*, "Defendant's Response to Plaintiff's Local Rule 56.1(b)(3)(C) Statement of Additional Facts," filed with the United States District Court for the Northern District of Illinois Eastern Division, case No. 1:09-CV-03339, filed Jul. 3, 2018, 93 pages.
*Kolcraft Enterprises, Inc.* v. *Chicco USA, Inc. d/b/a Artsana USA, Inc.*, "Memorandum Opinion and Order," issued by the United States District Court for the Northern District of Illinois Eastern Division, case No. 1:09-CV-03339, entered Jul. 6, 2018, 18 pages.
*Kolcraft Enterprises, Inc.* v. *Chicco USA, Inc. d/b/a Artsana USA, Inc.*, "Defendant's Reply Brief to Plaintiff's Response to Defendant's Motions in Limine: No. 1 to Exclude the Expert Report and Testimony of Frank A. Bernatowicz on Reasonable Royalty Damages (ECF #323); and No. 2 to Exclude the Expert Report and Testimony of Nicholas P. Godici on Prosecution History (ECF #328)," filed with the United States District Court for the Northern District of Illinois Eastern Division, case No. 1:09-CV-03339, filed Jul. 11, 2018, 23 pages.
*Kolcraft Enterprises, Inc.* v. *Chicco USA, Inc. d/b/a Artsana USA, Inc.*, "Defendant Artsana USA, Inc's Reply Brief to Plaintiff's Response to Defendant's Motions in Limine: No. 4 to Preclude Plaintiff From Making Certain Statements at Trial; and No. 5 to Limit use of the Deposition Testimony of Edward Bretschger and Tiffany Manzella," filed with the United States District Court for the Northern District of Illinois Eastern Division, case No. 1:09-CV-03339, filed Jul. 11, 2018, 8 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:09-CV-03339, entered Jul. 16, 2018, 10 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:09-CV-03339, entered Jul. 17, 2018, 2 pages.
*Kolcraft Enterprises, Inc.* v. *Chicco USA, Inc. d/b/a Artsana USA, Inc.*, "Defendant's Notice Re Pending Ex Parte Reexamination and Request for Relief," filed with the United States District Court for the Northern District of Illinois Eastern Division, case No. 1:09-CV-03339, filed Jul. 17, 2018, 23 pages.
*Kolcraft Enterprises, Inc.* v. *Chicco USA, Inc. d/b/a Artsana USA, Inc.*, "Defendant's Position Paper on Frank A. Bernatowicz's Methodology and Trial Testimony," filed with the United States District Court for the Northern District of Illinois Eastern Division, case No. 1:09-CV-03339, filed Jul. 18, 2018, 4 pages.
*Kolcraft Enterprises, Inc.* v. *Chicco USA, Inc. d/b/a Artsana USA, Inc.*, "Kolcraft's Position Paper Regarding Expert Report and Testimony of Frank A. Bernatowicz," filed with the United States District Court for the Northern District of Illinois Eastern Division, case No. 1:09-CV-03339, filed Jul. 18, 2018, 22 pages.
*Kolcraft Enterprises, Inc.* v. *Chicco USA, Inc. d/b/a Artsana USA, Inc.*, "Defendant's Supplemental Position Paper on Frank A. Bernatowicz's Replacement Expert Report," filed with the United States District Court for the Northern District of Illinois Eastern Division, case No. 1:09-CV-03339, filed Jul. 18, 2018, 4 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:09-CV-03339, entered Jul. 19, 2018, 3 pages.
*Kolcraft Enterprises, Inc.* v. *Chicco USA, Inc. d/b/a Artsana USA, Inc.*, "Order," issued by the United States District Court for the Northern District of Illinois Eastern Division, case No. 1:09-CV-03339, entered Jul. 22, 2018, 6 pages.
*Kolcraft Enterprises, Inc.* v. *Chicco USA, Inc. d/b/a Artsana USA, Inc.*, "Order: Plaintiff's Proposed Exhibits," issued by the United States District Court for the Northern District of Illinois Eastern Division, case No. 1:09-CV-03339, entered Jul. 22, 2018, 27 pages.
*Kolcraft Enterprises, Inc.* v. *Chicco USA, Inc. d/b/a Artsana USA, Inc.*, "Order: Defendant's Proposed Exhibits," issued by the United States District Court for the Northern District of Illinois Eastern Division, case No. 1:09-CV-03339, entered Jul. 22, 2018, 55 pages.
*Kolcraft Enterprises, Inc.* v. *Chicco USA, Inc. d/b/a Artsana USA, Inc.*, "Kolcraft's Supplemental Filing Regarding the Parties' Proposed Trial Exhibits," filed with the United States District Court for

(56) References Cited

OTHER PUBLICATIONS the Northern District of Illinois Eastern Division, case No. 1:09-CV-03339, filed Jul. 23, 2018, 34 pages.
*Kolcraft Enterprises, Inc.* v. *Chicco USA, Inc. d/b/a Artsana USA, Inc.*, "Defendant Artsana USA, Inc.'s Motion for Reconsideration of the Jul. 19, 2018 Order (ECF No. 349)," filed with the United States District Court for the Northern District of Illinois Eastern Division, case No. 1:09-CV-03339, filed Jul. 23, 2018, 1 page.
*Kolcraft Enterprises, Inc.* v. *Chicco USA, Inc. d/b/a Artsana USA, Inc.*, "Defendant Artsana USA, Inc.'s Memorandum of Law in Support of its Motion for Reconsideration of the Jul. 19, 2018 Order (ECF No. 349)," filed with the United States District Court for the Northern District of Illinois Eastern Division, case No. 1:09-CV-03339, filed Jul. 23, 2018, 141 pages.
*Kolcraft Enterprises, Inc.* v. *Chicco USA, Inc. d/b/a Artsana USA, Inc.*, "Defendant Artsana USA, Inc.'s Motions in Limine No. 6 to Exclude the Supplemental Expert Report and Testimony of Frank A. Bernatowicz on Reasonable Royalty Damages," filed with the United States District Court for the Northern District of Illinois Eastern Division, case No. 1:09-CV-03339, filed Jul. 23, 2018, 2 pages.
*Kolcraft Enterprises, Inc.* v. *Chicco USA, Inc. d/b/a Artsana USA, Inc.*, "Defendant Artsana USA, Inc.'s Memorandum of Law in Support of Motion in Limine No. 6 to Exclude the Supplemental Expert Report and Testimony of Frank A. Bernatowicz on Reasonable Royalty Damages," filed with the United States District Court for the Northern District of Illinois Eastern Division, case No. 1:09-CV-03339, filed Jul. 23, 2018, 12 pages.
*Kolcraft Enterprises, Inc.* v. *Chicco USA, Inc. d/b/a Artsana USA, Inc.*, "Defendant's Position Paper Regarding Issues Discussed at the Jul. 19, 2018 Pretrial Conference," filed with the United States District Court for the Northern District of Illinois Eastern Division, case No. 1:09-CV-03339, filed Jul. 23, 2018, 10 pages.
*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:09-CV-03339, entered Jul. 24, 2018, 1 page.
*Kolcraft Enterprises, Inc.* v. *Chicco USA, Inc. d/b/a Artsana USA, Inc.*, "Kolcraft's Response to Artsana's Request for a Trial Continuance," filed with the United States District Court for the Northern District of Illinois Eastern Division, case No. 1:09-CV-03339, filed Jul. 24, 2018, 5 pages.
*Kolcraft Enterprises, Inc.* v. *Chicco USA, Inc. d/b/a Artsana USA, Inc.*, "Kolcraft's Position Paper Regarding the Admissibility of Artsana's Alleged Gymini Prior Art Reference (DTX-36)," filed with the United States District Court for the Northern District of Illinois Eastern Division, case No. 1:09-CV-03339, filed Jul. 25, 2018, 95 pages.
*Kolcraft Enterprises, Inc.* v. *Chicco USA, Inc. d/b/a Artsana USA, Inc.*, "Defendant Artsana USA, Inc.'s Reply to Kolcraft's Response to Artsana's Request for a Trial Continuance," filed with the United States District Court for the Northern District of Illinois Eastern Division, case No. 1:09-CV-03339, filed Jul. 25, 2018, 3 pages.
*Kolcraft Enterprises, Inc.* v. *Chicco USA, Inc. d/b/a Artsana USA, Inc.*, "Kolcraft's Limited Additional Briefing Regarding Artsana's Request for a Trial Continuance," filed with the United States District Court for the Northern District of Illinois Eastern Division, case No. 1:09-CV-03339, filed Jul. 25, 2018, 7 pages.
*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:09-CV-03339, entered Jul. 25, 2018, 1 page.
*Kolcraft Enterprises, Inc.* v. *Chicco USA, Inc. d/b/a Artsana USA, Inc.*, "Motion for Leave to File Documents Under Seal," filed with the United States District Court for the Northern District of Illinois Eastern Division, case No. 1:09-CV-03339, filed Jul. 25, 2018, 2 pages.
*Kolcraft Enterprises, Inc.* v. *Chicco USA, Inc. d/b/a Artsana USA, Inc.*, "Defendant Artsana USA, Inc.'s Response to Kolcraft's Position Paper Regarding the Admissibility of Artsana's Alleged Gymini Prior Art Reference (DTX-36)," filed with the United States District Court for the Northern District of Illinois Eastern Division, case No. 1:09-CV-03339, filed Jul. 26, 2018, 67 pages.
*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:09-CV-03339, entered Jul. 26, 2018, 1 page.
*Kolcraft Enterprises, Inc.* v. *Chicco USA, Inc. d/b/a Artsana USA, Inc.*, "Defendant's Statement of Material Facts in Support of Motion for Summary Judgement," filed with the United States District Court for the Northern District of Illinois Eastern Division, case No. 1:09-CV-03339, filed Jun. 1, 2018, 819 pages. (Submitted as 6 parts).
*Kolcraft Enterprises, Inc.* v. *Chicco USA, Inc. d/b/a Artsana USA, Inc.*, "Defendant's Additional Trial Exhibits," filed with the United States District Court for the Northern District of Illinois Eastern Division, case No. 1:09-CV-03339, filed Aug. 24, 2018, 82 pages.
*Kolcraft Enterprises, Inc.* v. *Chicco USA, Inc. d/b/a Artsana USA, Inc.*, "Defendant's Motion for Judgement as a Matter of Law," filed with the United States District Court for the Northern District of Illinois Eastern Division, case No. 1:09-CV-03339, filed Aug. 29, 2018, 26 pages.
*Kolcraft Enterprises, Inc.* v. *Chicco USA, Inc. d/b/a Artsana USA, Inc.*, "Plaintiff's Motion for Judgment as a Matter of Law on Infringement and Validity," filed with the United States District Court for the Northern District of Illinois Eastern Division, case No. 1:09-CV-03339, filed Aug. 30, 2018, 7 pages.
*Kolcraft Enterprises, Inc.* v. *Chicco USA, Inc. d/b/a Artsana USA, Inc.*, "Defendant's Renewed Motion for Judgment as a Matter of Law," filed with the United States District Court for the Northern District of Illinois Eastern Division, case No. 1:09-CV-03339, filed Aug. 30, 2018, 26 pages.
*Kolcraft Enterprises, Inc.* v. *Chicco USA, Inc. d/b/a Artsana USA, Inc.*, "Entry," issued by the United States District Court for the Northern District of Illinois Eastern Division, case No. 1:09-CV-03339, entered Aug. 31, 2018, 1 page.
*Kolcraft Enterprises, Inc.* v. *Chicco USA, Inc. d/b/a Artsana USA, Inc.*, "Judgment in a Civil Case" issued by the United States District Court for the Northern District of Illinois Eastern Division, case No. 1:09-CV-03339, filed Sep. 4, 2018, 1 page.
*Kolcraft Enterprises, Inc.* v. *Chicco USA, Inc. d/b/a Artsana USA, Inc.*, "Report on the Filing or Determination of an Action Regarding a Patent or Trademark," issued by the United States District Court for the Northern District of Illinois Eastern Division, case No. 1:09-CV-03339, filed Sep. 5, 2018, 2 pages.
*Kolcraft Enterprises, Inc.* v. *Chicco USA, Inc. d/b/a Artsana USA, Inc.*, "Defendant's Artsana USA, Inc.'s Motion for a New Trial Pursuant to Fed. R. Civ. P. 59," filed with the United States District Court for the Northern District of Illinois Eastern Division, case No. 1:09-CV-03339, filed Sep. 28, 2018, 2 pages.
*Kolcraft Enterprises, Inc.* v. *Chicco USA, Inc. d/b/a Artsana USA, Inc.*, "Defendant's Artsana USA, Inc.'s Memorandum in Support of its Motion for a New Trial Pursuant to Fed. R. Civ. P. 59," filed with the United States District Court for the Northern District of Illinois Eastern Division, case No. 1:09-CV-03339, filed Sep. 28, 2018, 29 pages.
*Kolcraft Enterprises, Inc.* v. *Chicco USA, Inc. d/b/a Artsana USA, Inc.*, "Defendant's Artsana USA, Inc.'s Renewed Motion for Judgment as a Matter of Law Pursuant to Fed.R.Civ. P. 50(b)," filed with the United States District Court for the Northern District of Illinois Eastern Division, case No. 1:09-CV-03339, filed Sep. 28, 2018, 2 pages.
*Kolcraft Enterprises, Inc.* v. *Chicco USA, Inc. d/b/a Artsana USA, Inc.*, "Defendant's Artsana USA, Inc.'s Memorandum in Support of its Renewed Motion for Judgment as a Matter of Law Pursuant to Fed.R.Civ. P. 50(b)," filed with the United States District Court for the Northern District of Illinois Eastern Division, case No. 1:09-CV-03339, filed Sep. 28, 2018, 30 pages.
*Kolcraft Enterprises, Inc.* v. *Chicco USA, Inc. d/b/a Artsana USA, Inc.*, "Plaintiff's Motion for Entry of a Permanent Injunction," filed with the United States District Court for the Northern District of Illinois Eastern Division, case No. 1:09-CV-03339, filed Oct. 2, 2018, 131 pages.

(56) References Cited

OTHER PUBLICATIONS

*Kolcraft Enterprises, Inc.* v. *Chicco USA, Inc. d/b/a Artsana USA, Inc.*, "Plaintiff's Motion for Enhanced Damages, Attorney Fees, and Post-Judgment Interest," filed with the United States District Court for the Northern District of Illinois Eastern Division, case No. 1:09-CV-03339, filed Oct. 2, 2018, 76 pages.

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:09-CV-03339, filed Oct. 10, 2018, 2 pages.

United States Patent and Trademark Office, "Notice of Intent to Issue Ex Parte Reexamination Certificate," issued in connection with reexamination control No. 90/014,062, corresponding to U.S. Pat. No. 7,376,993, dated Oct. 2, 2018, 19 pages.

United States Patent and Trademark Office, "Litigation Search Report CRU 3999," issued in connection with reexamination control No. 90/014,062, corresponding to U.S. Pat. No. 7,376,993, dated Sep. 27, 2018, 171 pages.

"Supplemental Response to Office Action," filed with the United States Patent and Trademark Office in connection with reexamination control No. 90/014,062, corresponding to U.S. Pat. No. 7,376,993, dated Sep. 18, 2018, 35 pages.

*Kolcraft Enterprises, Inc.* v. *Chicco USA, Inc. d/b/a Artsana USA, Inc.*, "Defendant Response to Plaintiff's Motion for Entry of a Permanent Injunction," filed with the United States District Court for the Northern District of Illinois Eastern Division, case No. 1:09-CV-03339, filed Nov. 19, 2018, 59 pages.

*Kolcraft Enterprises, Inc.* v. *Chicco USA, Inc. d/b/a Artsana USA, Inc.*, "Plaintiff's Response to Defendant's Renewed Motion for Judgment as a Matter of Law (Dkt. #432)," filed with the United States District Court for the Northern District of Illinois Eastern Division, case No. 1:09-CV-03339, filed Nov. 26, 2018, 198 pages.

*Kolcraft Enterprises, Inc.* v. *Chicco USA, Inc. d/b/a Artsana USA, Inc.*, "Defendant Response to Plaintiff's Motion for Enhanced Damages and Attorney Fees," filed with the United States District Court for the Northern District of Illinois Eastern Division, case No. 1:09-CV-03339, filed Nov. 26, 2018, 202 pages.

*Kolcraft Enterprises, Inc.* v. *Chicco USA, Inc. d/b/a Artsana USA, Inc.*, "Plaintiff's Response to Defendant's Motion for a New Trial (Dkt. #430)," filed with the United States District Court for the Northern District of Illinois Eastern Division, case No. 1:09-CV-03339, filed Nov. 26, 2018, 95 pages.

*Kolcraft Enterprises, Inc.* v. *Chicco USA, Inc. d/b/a Artsana USA, Inc.*, "Plaintiff's Reply in Support of Its Motion for Entry of a Permanent Injunction (Dkt. #438)," filed with the United States District Court for the Northern District of Illinois Eastern Division, case No. 1:09-CV-03339, filed Dec. 3, 2018, 9 pages.

*Kolcraft Enterprises, Inc.* v. *Chicco USA, Inc. d/b/a Artsana USA, Inc.*, "Defendant Artsana USA Inc.'s Reply in Support of its Renewed Motion for Judgment as a Matter of Law Pursuant to Fed. R. Civ. O. 50(b) (EDF 432-433)," filed with the United States District Court for the Northern District of Illinois Eastern Division, case No. 1:09-CV-03339, filed Dec. 10, 2018, 108 pages.

*Kolcraft Enterprises, Inc.* v. *Chicco USA, Inc. d/b/a Artsana USA, Inc.*, "Defendant Artsana USA Inc.'s Reply in Support of its Motion for a New Trial Pursuant to Fed. R. Civ. P. 59 [ECF 430-431]," filed with the United States District Court for the Northern District of Illinois Eastern Division, case No. 1:09-CV-03339, filed Dec. 10, 2018, 88 pages.

*Kolcraft Enterprises, Inc.* v. *Chicco USA, Inc. d/b/a Artsana USA, Inc.*, "Plaintiff's Reply in Support of Its Motion for Enhanced Damages, Attorney Fees, and Post-Judgment Interest (Dkt. #440)" filed with the United States District Court for the Northern District of Illinois Eastern Division, case No. 1:09-CV-03339, filed Dec. 10, 2018, 55 pages.

*Kolcraft Enterprises, Inc.* v. *Chicco USA, Inc. d/b/a Artsana USA, Inc.*, "Defendant's Motion for Leave to File Sur-Reply to Plaintiff's Motion for Permanent Injunction," filed with the United States District Court for the Northern District of Illinois Eastern Division, case No. 1:09-CV-03339, filed Dec. 17, 2018, 6 pages.

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:13-CV-04863, filed Jan. 24, 2019, 1 page.

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:13-CV-04863, filed Feb. 7, 2019, 1 page.

*Kolcraft Enterprises, Inc.* v. *Chicco USA, Inc. d/b/a Artsana USA, Inc.*, "Defendant's Motion for Leave to File First Amended Affirmative Defenses," filed with the United States District Court for the Northern District of Illinois Eastern Division, case No. 1:13-CV-04863, filed Feb. 25, 2019, 28 pages.

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:13-CV-04863, filed Feb. 28, 2019, 1 page.

*Kolcraft Enterprises, Inc.* v. *Chicco USA, Inc. d/b/a Artsana USA, Inc.*, "Defendant Artsana USA, Inc.'s First Amended Affirmative Defenses," filed with the United States District Court for the Northern District of Illinois Eastern Division, case No. 1:109-CV-04863, filed Feb. 28, 2019, 5 pages.

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:109-CV-04863, filed Feb. 27, 2019, 1 page.

*Kolcraft Enterprises, Inc.* v. *Chicco USA, Inc. d/b/a Artsana USA, Inc.*, "Joint Motion to Determine Basis for Disputes to Proposed Undisputed Facts and to Extend Summary Judgment Deadline," filed with the United States District Court for the Northern District of Illinois Eastern Division, case No. 1:13-CV-04863, filed Apr. 8, 2019, 375 pages. (The upload is still between 3 parts).

*Kolcraft Enterprises, Inc.* v. *Chicco USA, Inc. d/b/a Artsana USA, Inc.*, "Notification of Docket Entry," issued by the United States District Court for the Northern District of Illinois Eastern Division, case No. 1:13-CV-04863, filed Apr. 11, 2019, 1 page.

* cited by examiner

PLAY GYMS AND METHODS OF OPERATING THE SAME

RELATED APPLICATIONS

This patent arises from a continuation of U.S. patent application Ser. No. 13/756,168, filed on Jan. 31, 2013, which is a continuation of U.S. patent application Ser. No. 13/589,777, filed on Aug. 20, 2012, and issued as U.S. Pat. No. 8,388,501, which is a continuation of U.S. patent application Ser. No. 12/062,670, filed on Apr. 4, 2008, and issued as U.S. Pat. No. 8,257,229, which is a continuation of U.S. patent application Ser. No. 10/725,071, filed on Dec. 1, 2003, and issued as U.S. Pat. No. 7,376,993, which is a continuation of U.S. patent application Ser. No. 10/431,079, filed on May 7, 2003, now abandoned. U.S. patent application Ser. No. 13/756,168, U.S. patent application Ser. No. 13/589,777, U.S. patent application Ser. No. 12/062,670, U.S. patent application Ser. No. 10/725,071 and U.S. patent application Ser. No. 10/431,079 are hereby incorporated herein by reference in their entireties.

FIELD OF THE DISCLOSURE

This disclosure relates generally to child care products, and, more particularly, to play gyms and methods of operating the same.

BACKGROUND

In recent years, portable play yards have become very popular. Portable play yards typically include a frame, a fabric enclosure supported by the frame, and a removable floor board or mat. The frame is largely or completely contained within the fabric enclosure so that there are few if any loose parts when the frame is collapsed or when the frame is erected. When collapsed, the portable play yard typically has a compact form factor to enable easy transport and storage of the play yard. Sometimes, the floor board is wrapped around the collapsed frame to prevent the frame from inadvertently leaving the collapsed state.

Sometimes, these portable play yards are provided with a portable bassinet. The portable bassinet is typically suspended within the top of the play yard by hooking the bassinet to the upper rails of the play yard frame and permitting the bassinet to extend downward into the enclosure of the play yard. With the exception of depth (which is significantly lower, often one-quarter to one half the depth of the play yard enclosure), the bassinet may have substantially the same size as the play yard enclosure (i.e., substantially the same width and length), or may be smaller than the play yard enclosure (e.g., substantially the same width but approximately one-half the length). The bassinet is used with infants. When the bassinet is installed, the play yard enclosure cannot be occupied by a child, although the area below the bassinet may sometimes be used for storage of inanimate objects. When the child grows sufficiently, the bassinet is removed from the play yard and the play yard is used to house the child.

The floor mat of the play yard may be used as the floor of the play yard and/or the bassinet. In examples in which the bassinet has a smaller floor area than the play yard that supports the bassinet, the floor board may be folded (e.g., doubled up) to be used as the floor of the bassinet and fully extended to be used as the floor of the play yard.

Mats for use on a floor with an over-arching play gym have also become popular in recent years. For instance, in a known prior art device, a play gym having two flexible arches for suspending objects such as toys or the like is coupled to the corners of a rectangular mat via snaps or the like. The arches cross and are snapped to one another roughly above the middle of the mat. A small child placed on the mat may be entertained by the suspended objects. Because the play gym's arches are flexible, the suspended objects tend to bounce and move in response to vibrations such as those that might be caused by the child batting his/her hands and/or feet at the objects.

DETAILED DESCRIPTION

Figure 1:
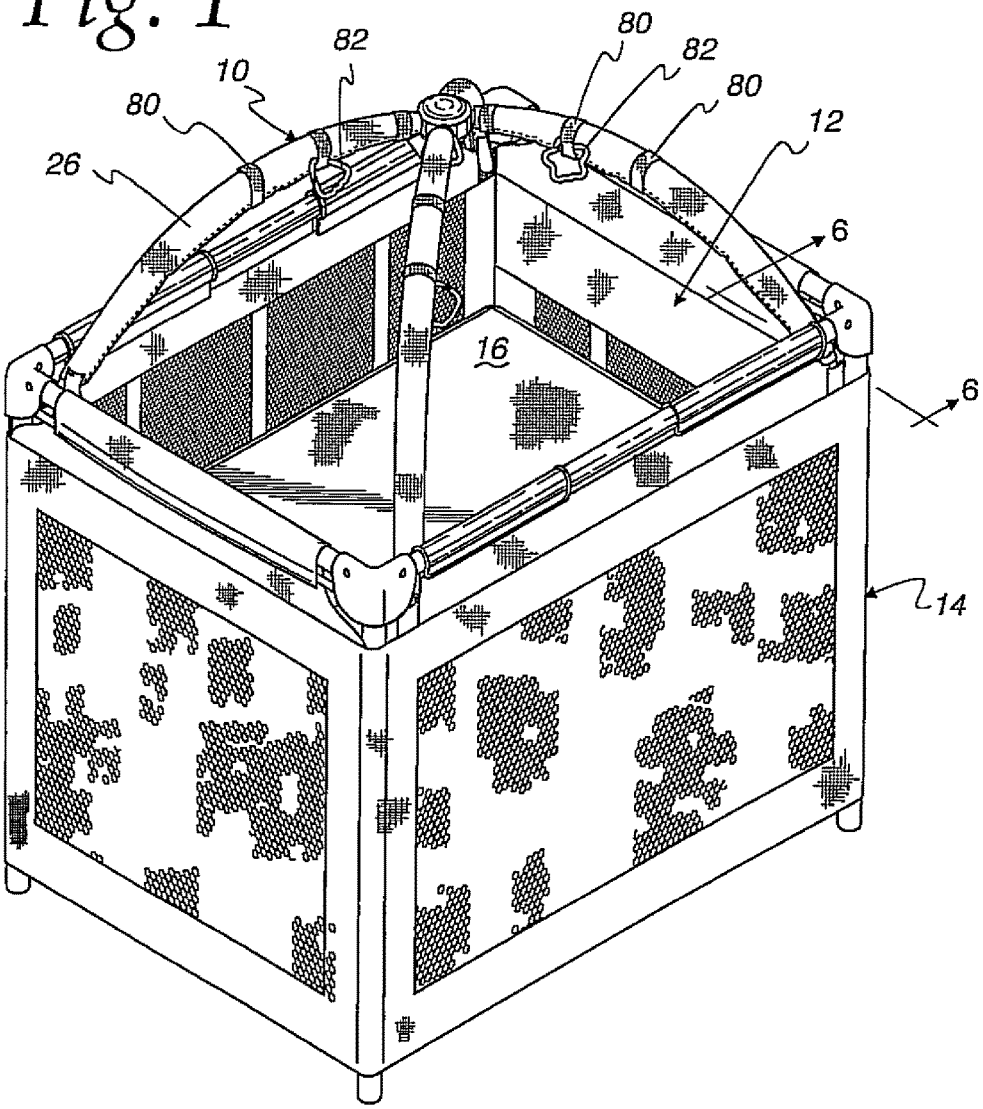
FIG. 1 is a perspective view of an example play yard, an example bassinet, and an example play gym.
Figure 2:
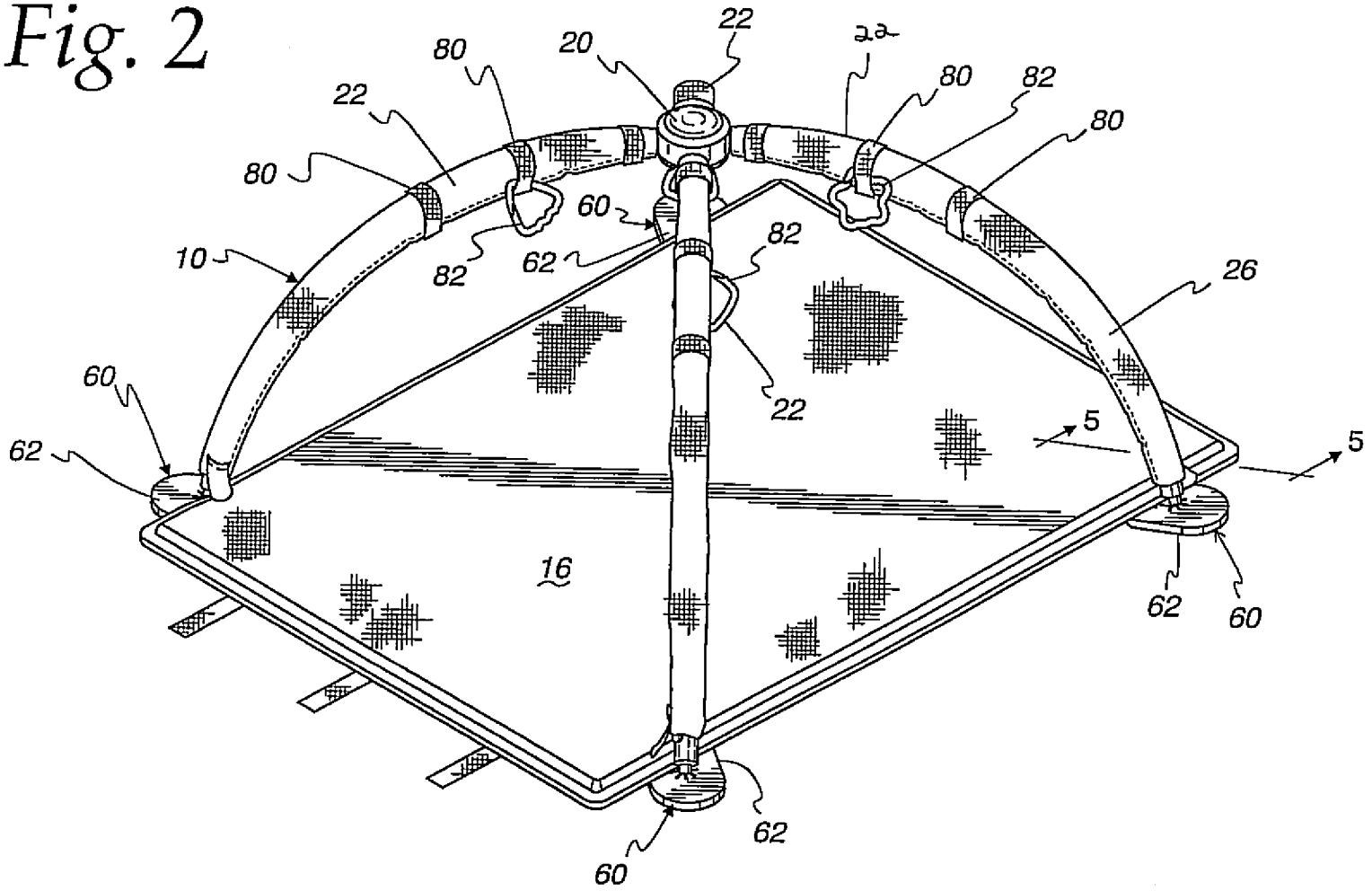
FIG. 2 is a perspective view of the example play gym of FIG. 1 when removed from the play yard and bassinet, and coupled to a floor mat of the play yard and bassinet.

FIG. 1 is a perspective view of an example play gym 10 mounted to an example bassinet 12 which is, in turn, mounted to an example portable play yard 14. The illustrated play gym 10 is structured to suspend an object such as a toy above the bassinet 12 and/or the play yard 14 as explained below. Additionally, the play gym 10 is structured to suspend the same or a different object above a mat 16 separate from the bassinet 12 and the play yard 14 as shown in FIG. 2. In the illustrated example, the mat 16 is a removable floor board or mat 16 which is used as the floor of at least one of the bassinet 12 and the play yard 14. Thus, as shown in FIG. 1, the illustrated play gym 10 has a first mode in which it suspends an object above the mat 16 when the mat 16 is positioned in the bassinet 12 and/or the play yard 14. As shown in FIG. 2, the play gym 10 also has a second mode in which it suspends the same or a different object above the mat 16 when the mat 16 is removed from the bassinet 12 and/or the play yard 14, and the mat 16 is positioned on another surface such as the floor of a house. Whereas in the first mode, the play gym 10 supports the object above any or all of the bassinet 12, the play yard 14, and the mat 16, in the second mode the play gym 10 supports the object above the mat 16, but not above the play yard 14 or the bassinet 12.

The play yard 14 may be constructed in any manner. For example, it can be constructed like any of the portable play yards sold by such companies as Kolcraft Enterprises, Graco Children's Products, Evenflo, Cosco, etc. The play yard 14 may collapse into a rectangular package, may fold into a generally planar configuration (e.g., by folding in half), and/or may not be foldable. Although shown as a rectangular structure, the play yard 14 may have any other desired shape or configuration (e.g., square, triangular, round, etc.)

Similarly, the bassinet 12 may be constructed in any desired manner and/or shape. For example, the bassinet 12 may be constructed like any of the bassinets sold by such companies as Kolcraft Enterprises, Graco Children's Products, Evenflo, Cosco, etc. For instance, the bassinet 12 may be a framed or frameless bassinet that is removably suspended by hooks, snaps or any other type of fastening technique within the play yard 14. The bassinet 12 may have the same general shape and floor area as the play yard 14 as shown in FIG. 1, or may have a different shape and/or less floor space then the play yard 14 (e.g., half the floor space of the play yard 14). Alternatively, the bassinet 12 may be a stand alone unit that is not intended for use with a play yard, is erected apart from a play yard 14, and/or is not collapsible.

As mentioned above, in the illustrated example the floor mat 16 is adapted for use as a floor for the bassinet 12 and/or the play yard 14. Thus, the floor mat 16 is dimensioned to be positioned within at least one of the bassinet 12 and the play yard 14. Since, in the illustrated example, the play yard 14 and the bassinet 12 are not intended to be in use at the same time, one floor mat 16 is provided for use with both the play yard 14 and the bassinet 12 and, thus, the floor mat 16 is dimensioned to be used with both of those structures. Alternatively, two different floor mats 16 of the same or different size and/or construction may be provided.

As used herein, the terms "floor mat" and "floor board" are equivalent and interchangeable. The floor mat 16 may be implemented in any desired manner. For example, the floor mat 16 may be a completely flexible mat made of foam, cloth, plastic and/or other materials. In the illustrated example, however, the floor mat 16 is at least partially rigid to provide a substantially solid floor for the play yard 14 and/or bassinet 12 and to provide enhanced support for a child disposed on the mat 16. In examples in which the floor mat 16 is at least partially rigid, the floor mat 16 may include a pad secured to one or more boards. The pad and board(s) may be encased in a plastic sleeve as is conventional in portable play yards sold today such as the Travelin' Tot play yard sold by Kolcraft Enterprises. If the floor mat 16 includes multiple boards, adjacent boards may be positioned along a seam to facilitate folding of the mat 16 in discrete sections. For example, the floor mat 16 may include four solid boards and be foldable in fourths for wrapping around the collapsed play yard 14 during storage and/or transport. In the illustrated example, the play yard 14 and the bassinet 12 have substantially the same floor space and the floor mat 16 is, thus, inserted into the play yard 14 and the bassinet 12 in substantially the same orientation (e.g., flat without folding). In examples in which the bassinet 12 and the play yard 14 have different sizes and/or shapes, the floor mat 16 may be folded (e.g., in half) for insertion into one or both of the bassinet 12 and/or the play yard 14.

The floor mat 16 may be removably secured in the bassinet 12 and/or the play yard 14 by any suitable fasteners. For example, the floor mat 16 may be secured to the bassinet 12 and/or the play yard 14 by Velcro strips. Alternatively, the floor mat 16 may be held in place by gravity without the benefit of fasteners.

The illustrated play gym 10 includes a hub 20 and four legs 22, although persons of ordinary skill in the art will readily appreciate that no hub and/or fewer or more than four legs 22 may alternatively be employed. For instance, the play gym 10 may include only one leg that forms an arch over the mat 16, the bassinet 12, and/or the play yard 14 without the benefit of a hub. Alternatively, the play gym 10 may include two or more legs that cross near the center of the mat 16, the bassinet 12 and/or the play yard 14; again with or without the benefit of a hub. The legs may form crossing arches and the arches may be coupled to one another either directly or through a hub.

Figure 3:
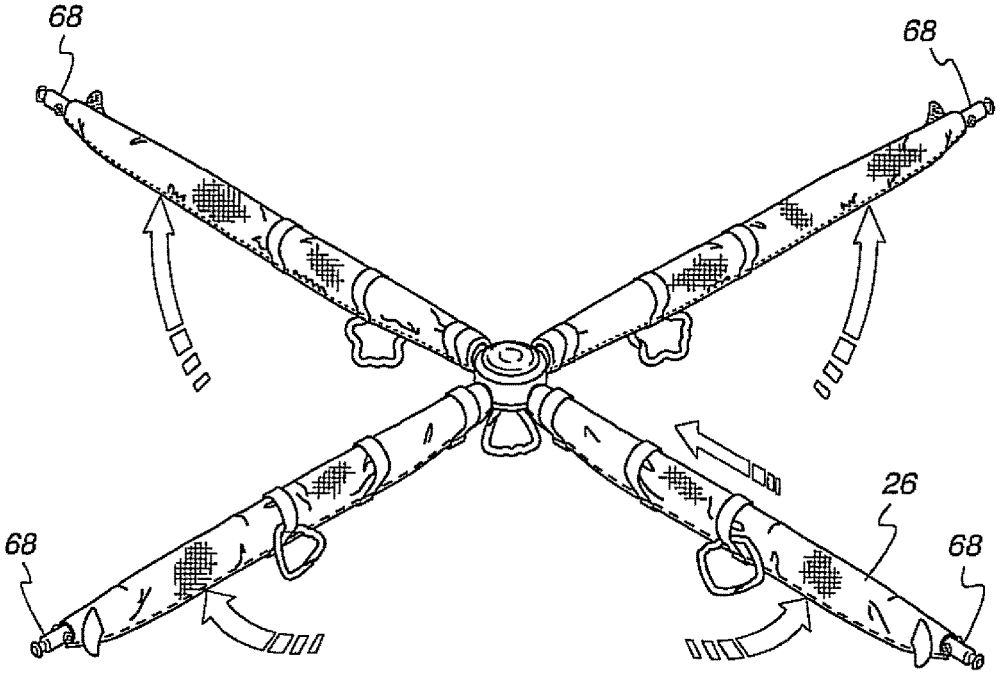
FIG. 3 illustrates the example play gym of FIGS. 1 and 2 in an expanded state before the play gym is coupled to a play yard, a bassinet or a floor mat.

In the illustrated example, the legs 22 of the play gym 10 are flexible such that they can be bent into the arched position shown in FIGS. 1 and 2, but will spring back to the generally planar position shown in FIG. 3 when released from the mat 16, the bassinet 12, and/or the play yard 14. In the illustrated example, the legs 22 are implemented by flexible plastic tubes 24 (see FIGS. 5 and 7-9) encased in a plastic, vinyl, or cloth covering 26 (see FIGS. 5 and 6), although legs of other forms and materials with or without coverings of the same or different materials may likewise be employed.

Figure 4:
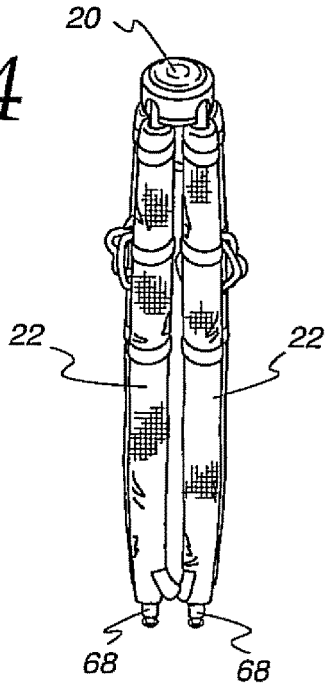
FIG. 4 illustrates the example play gym of FIG. 3 in a folded state.

In the illustrated example, the legs 22 are pivotably coupled to the hub 20 such that they can be pivoted between a stored position wherein the legs 22 are positioned generally parallel to each other as shown in FIG. 4, and an extended position wherein the legs 22 extend generally radially outward from the hub 20 as shown in FIG. 3. Persons of ordinary skill in the art will readily appreciate that the legs 22 may be coupled to the hub 20 in any number of ways. In the illustrated example, each of the legs 22 defines a slot 30 (see FIGS. 7-9) and the hub 20 includes a plurality of pins 32. Each of the pins 32 is positioned in a respective one of the slots 30. The pins 32 and slots 30 are dimensioned such that each of the legs 22 may pivot about its respective pin 32 and/or slide along its respective longitudinal axis toward and away from the hub 20. The permitted slide distance is defined by the size of the corresponding slot 30 and pin 32.

Figure 7:
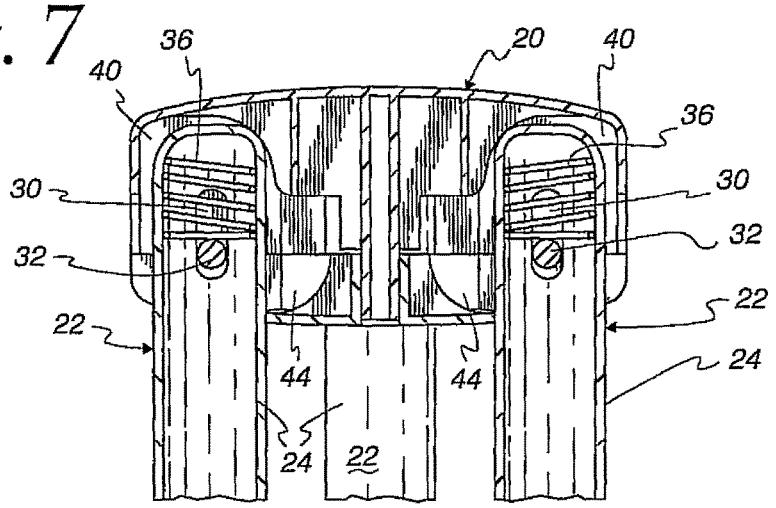
FIG. 7 is a cross-sectional view of the hub and some of the legs of the example play gym of FIGS. 1-6 and showing the legs in a folded position suitable for storing the play gym.
Figure 8:
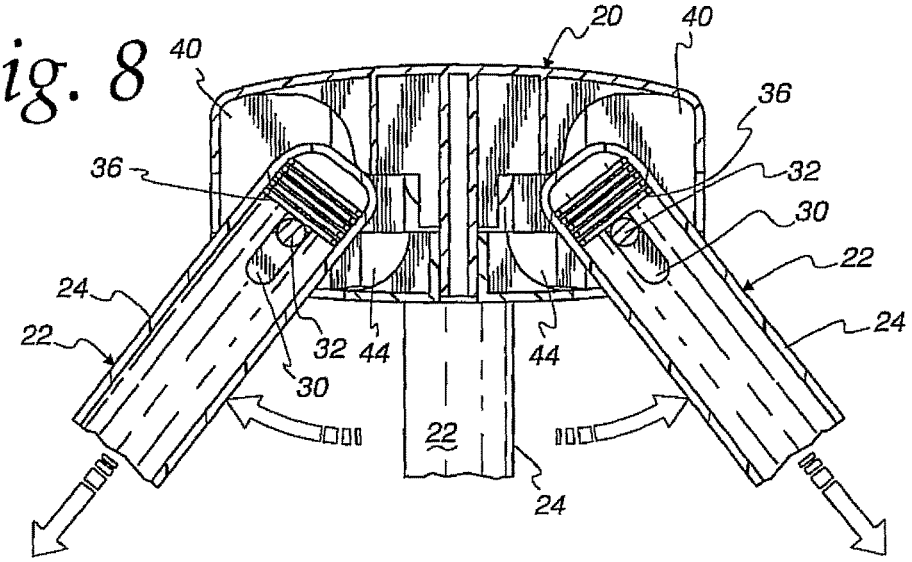
FIG. 8 is a view similar to FIG. 7, but showing the legs being moved between the extended and locked positions.
Figure 9:
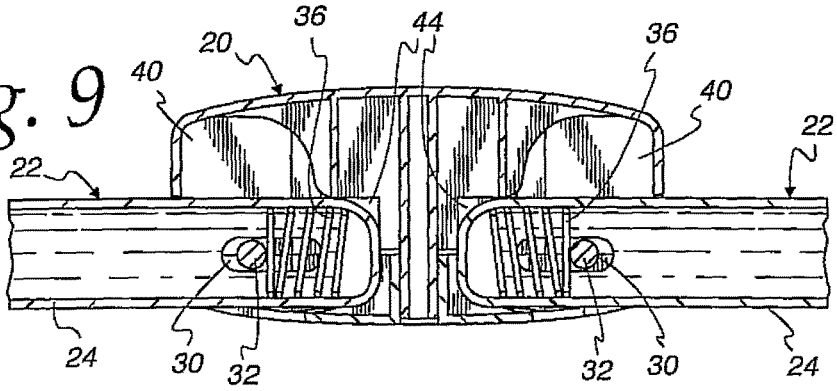
FIG. 9 is a view similar to FIG. 7, but showing some of the legs in the extended position suitable for erecting the play gym.

To bias the legs 22 toward the hub 20, each of the legs is further provided with a spring 36. As shown in FIGS. 7-9, in the illustrated example the springs 36 are helical springs located within respective ones of the legs 22. One end of each of the springs 36 is positioned adjacent an inner end of its respective leg 22, while the other end of each spring 36 abuts one of the pins 32. As a result, absent a countervailing force, the springs 36 force the pins 32 toward the bottom of their respective slots 30 (see FIGS. 7 and 9). In other words, the springs 36 force their respective legs 22 toward the hub 20 unless a countervailing force is applied pulling the legs away from the hubs 20.

To define the stored and extended positions of the legs 22, the hub 20 defines a plurality of cavities 40, 44. A first set of the cavities 40 is positioned to prevent the legs 22 from pivoting when the legs 22 are in the stored position. The second set of cavities 44 is positioned to prevent the legs 22 from pivoting when the legs 22 are in the extended position. Thus, each of the legs 22 is associated with a pair of cavities, namely, one of the cavities 40 from the first set and one of the cavities 44 from the second set.

More specifically, each of the cavities 40, 44 is dimensioned to receive an end of a respective one of the legs 22 when the leg 22 is in one of the stored position and the extended position. As discussed above, the springs 36 bias the legs toward the hub 20. This biasing force biases the legs 22 into engagement with respective ones of the cavities 40, 44. When the ends of the legs 22 are positioned in a corresponding cavity 40, 44, the walls of the cavity 40, 44 prevent the legs 22 from pivoting out of the cavity. Thus, when an end of a leg 22 is positioned in its first corresponding cavity 40, the walls of the cavity 40 prevent the leg 22 from pivoting out of the stored position. Similarly, when the end of the leg 22 is positioned in its second corresponding cavity 44, the walls of the cavity 44 prevent the leg from pivoting out of the extended position. As a result, when it is desirable to pivot a leg 22 between the extended and stored positions, a user must pull that leg 22 against the force of the spring 36 a distance away from the hub 20 such that the end of the leg 22 can be pivoted out of one of the cavities 40, 44 and into the other one of the cavities 40, 44 (see FIG. 8). The dimensions of the slots 30 are, therefore, chosen to permit sufficient longitudinal movement of the legs 22 to permit withdrawal of the legs 22 from the cavities 40, 44. As shown in FIGS. 7-9, in the illustrated example, the cavities 40, 44 of each pair of cavities are positioned at generally right angles so that the corresponding leg 22 must be pivoted approximately ninety degrees to move that leg between the extended and stored positions.

To removably couple the play gym 10 to at least one of the bassinet 12 and the play yard 14, at least one of the mat 16, the bassinet 12 and the play yard 14 is provided with connectors 50. Persons of ordinary skill in the art will readily appreciate that the connectors 50 may be implemented in any number of ways. In the illustrated example, the connectors 50 are implemented by fabric pockets 50 which are sewn or otherwise fastened adjacent the corners of the bassinet 12 and/or the play yard 14 (see FIG. 6). The ends of the legs 22 opposite the hub 20 are positioned in respective ones of these pockets 50 to thereby couple the play gym 10 to the bassinet 12 and/or the play yard 14. As shown in FIG. 1, to position all of the legs 22 in their corresponding pockets 50, the legs 22 must be bent into an arcuate shape thereby causing the play gym 10 to form a pair of arches crossing one another at the hub 20 over the bassinet 12 and/or the play yard 14. Preferably, the lengths of the legs 22 are selected to be substantially equal such that the arches cross in the middle of the bassinet 12 and/or the play yard 14 (i.e., such that the hub 20 or, if no hub is present, the point of crossing of the legs 22, is located above the center of the bassinet 12 and/or the play yard 14).

Preferably the legs 22 are selected such that, after being bent, the legs 22 will seek to return to their original, generally straight condition (see FIG. 3). As a result, when the legs 22 are bent into the arched position shown in FIG. 1, each of the ends of the legs 22 will apply a force away from the center of the bassinet 12 and/or the play yard 14 seeking to return the legs 22 into the straight position. These forces act to bias the hub 20 upward away from the bassinet 12 and/or the play yard 14 and to bias the free ends of the legs 22 into tight engagement with the sides of the pockets 50 (and, thus, with the frame of the bassinet 12 and/or play yard 14) to thereby securely hold the play gym 10 above the bassinet 12 and/or the play yard 14.

While in the illustrated example the connectors 50 are located on the bassinet 12, connectors 50 could alternatively or additionally be located on the play yard 14 such that, if desired, the play gym 10 could be mounted to the play yard 14 without the bassinet 12. Alternatively, no connectors 50 may be located on the bassinet 12 and/or the play yard 14, and the play gym 10 can instead be coupled to the bassinet 12 and/or the play yard 14 via direct connection to the mat 16. In such an approach, the mat 16 may include non-pivoting connectors located within the perimeter of the mat 16 and accessible from the top of the mat 16 to permit the mat 16 to be inserted and/or withdrawn from the bassinet 12 and/or play yard 14 without interference from the connectors and possibly with the play gym 10 still attached to the mat 16.

To removably couple the play gym 10 to the mat 16, the mat 16 is further provided with a plurality of connectors 60. To removably join the legs 22 to the connectors 60, each of the legs 22 preferably terminates in a foot 68 having a diameter approximately equal to the diameter of the leg 22, and a reduced diameter ankle 70 located between the foot 68 and the leg 22 (see FIG. 5). The feet 68 and ankles 70 may be integrally formed into a single piece and fastened to their corresponding legs 22 by a fastener such as a rivet as shown in FIGS. 3 and 8, or may be integrally formed with their corresponding legs 22.

Figure 5:
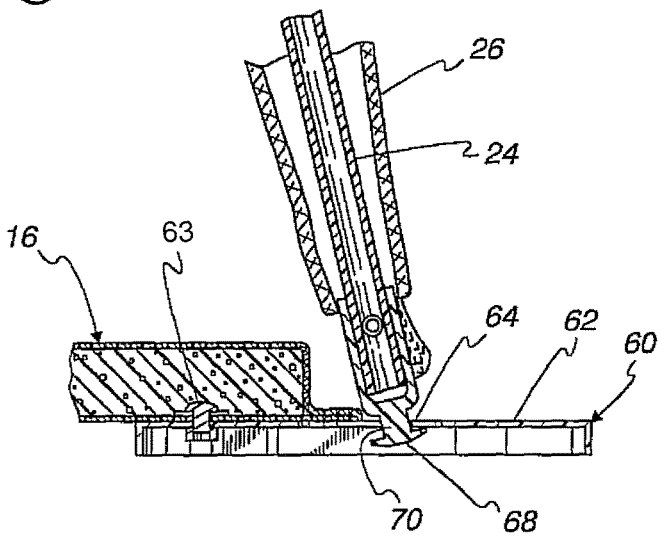
FIG. 5 is a cross-sectional view of an example connector joining the example play gym of FIGS. 1-4 to the example floor board of FIG. 2.
Figure 6:
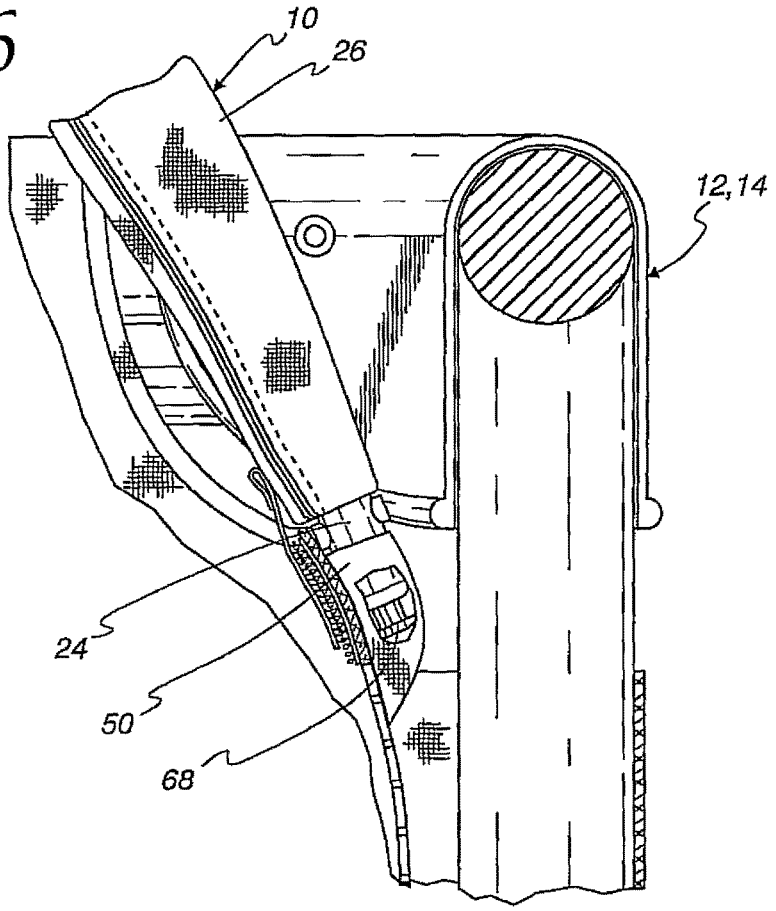
FIG. 6 is a partial cross-sectional view of an example connector joining the example play gym of FIGS. 1-5 to an example bassinet or play yard.

As shown in FIGS. 2 and 5, in the illustrated example each of the connectors 60 is implemented by a plate 62 that defines an aperture 64 for receiving a respective one of feet 68 of the legs 22. Preferably, each of the apertures 64 comprises an enlarged end or opening dimensioned to receive the foot 68 of a respective one of the legs 22. The enlarged end of the aperture 64 is in communication with a longitudinal slot having a length and a width. The width of each slot is preferably smaller than the diameter of the foot 68 and slightly larger than the diameter of the ankle 70 such that the leg 22 can easily move along the slot without withdrawing from the aperture 64. The end of the aperture 64 opposite the enlarged end may include radial slots 74 as shown in FIG. 2 to facilitate withdrawal of the feet 68 when desired.

In the illustrated example, each of the connectors 60 is pivotably coupled to the mat 16 for movement between a first position wherein the plate 62 is entirely within the perimeter of the mat 16 and a second position wherein the plate 62 lies at least partially outside of the perimeter of the mat 16. In the illustrated example, the plate 62 is pivotably coupled to the underside of the mat 16 via a rivet 63 (see FIG. 5). Thus, when the plate 62 is moved to its first position (i.e., within the perimeter of the mat 16), the connector 60 is located beneath the mat 16, but when the plate 62 is moved to its second position, at least a portion of the connector 60 is not disposed beneath the mat 16. Since, in the illustrated example, the mat 16 is intended to be used as the floor of the bassinet 12 and the play yard 14, the perimeter of the mat 16 closely matches the inner perimeter of the floor of the bassinet 12 and the inner perimeter of the floor of the play yard 14. As a result, when the user desires to use the mat 16 in one of the bassinet 12 and the play yard 14, the connectors 60 are pivoted in to their first positions so that they do not interfere with positioning the connectors 60 within the bassinet 12 or the play yard 14. When, however, it is desired to use the mat 16 with the play gym 10 apart from the bassinet 12 and/or the play yard 14, the connectors 60 are pivoted to their second positions where they can be engaged by the legs 22 of the play gym 10.

Although in the illustrated example the connectors 60 are coupled to an undersurface of the mat 16, persons of ordinary skill in the art will readily appreciate that the connectors 60 could alternatively be connected to other portions of the mat 16. For example, the connectors 60 may be adapted to move into and out of the side edges of the mat 16 or connected to a top surface of the mat 16. Alternatively, the connectors 60 may not be pivoted to the mat 16 and/or the connectors may be located within the perimeter of the mat 16 to permit coupling of the play gym 10 to the mat 16 when the mat 16 is located within the bassinet 12 and/or the play yard 14.

The enlarged ends of the slots of the apertures 64 are preferably located near the edges of the mat 16 when the connectors 60 are positioned in their extended positions outside of the perimeter of the mat 16. As a result, when the legs 22 are coupled to the connectors 60, they are inserted into the enlarged ends of the apertures 64 near the perimeter of the mat 16. When the legs 22 are released, they will attempt to move from their bent position toward a straight position as explained above. Therefore, the legs 22 are biased to slide away from the perimeter of the mat 16 and away from the enlarged ends of the apertures 64 such that the ankles 70 slide along the slots and the feet 68 run under the plates 62 to thereby secure the legs 22 to the mat 16.

Any or all of the legs 22 of the play gym 10 may be provided with straps 80 and/or split rings 82 to permit objects such as toys to be selectively attached and detached from the play gym 10. Example straps 80 and split rings 82 are shown in FIGS. 1 and 2.

In operation, a user wishing to use the play gym 10 may first erect a bassinet 12 and/or a play yard 14. Erecting the bassinet 12 and/or the play yard 14 may include positioning a floor mat 16 within one or both of the bassinet 12 and the play yard 14. The user may then secure the play gym 10 at least partially above one or both of the bassinet 12 and the play yard 14 by, for example, inserting the feet 68 of the legs 22 into the connectors 50 of the bassinet 12 and/or play yard 14 or into the connectors of the mat 16.

If the user wishes to use the play gym 10 apart from the bassinet 12 and the play yard 14, the user may remove the play gym 10 from the bassinet 12 and/or the play yard 14 by, for example, withdrawing the feet from the connectors 50. If the user desires to use the play gym 10 with the mat 16, the user may then remove the mat 16 from the bassinet 12 and/or the play yard 14 and position the mat 16 in a desired location of use. If pivotable connectors 60 are employed as in the illustrated example, the user may then pivot the connectors 60 out from their first positions within the perimeter of the mat 16 to their second positions outside the perimeter of the mat 16. The user may then secure the play gym 10 to the floor mat 16 by, for example, inserting the feet 68 of the legs 22 into corresponding ones of the apertures 64 of the connectors 60.

If the user desires to store the play gym 10, the user may remove the feet 68 of the legs 22 from the apertures 64 to thereby remove the play gym 10 from the floor mat 16. The user may then collapse the play gym 10 by moving the legs 22 from their extended positions (see FIG. 3) to their stored positions (see FIG. 4). To move a leg 22 to the stored position, the user may pull the leg 22 against the force of the spring 36 in a direction away from the hub 20 such that the end of the leg 22 is withdrawn from the cavity 44 and the leg 22 enters a first intermediate position. The user may then pivot the leg 22 into a second intermediate position and permit the spring 36 to pull the end of the leg 22 into the corresponding cavity 40 of the hub 20 to move the leg 22 into the stored position. The above procedures may be repeated with each of the legs 22 until all of the legs 22 are in the stored position.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus comprising:

a floor;

a first fastener coupled to the floor to removably secure the floor to at least one of a play yard or a bassinet;

a connector coupled to a surface of the floor, the connector having an opening positioned adjacent an edge of the floor to cooperate with a second fastener; and a play gym having a first leg including the second fastener, the play gym being removably coupled to the connector via the second fastener.

2. The apparatus of claim 1, wherein the connector includes a base having the opening formed therein.

3. The apparatus of claim 2, wherein the base of the connector is attached to the surface of the floor via a third fastener.

4. The apparatus of claim 1, wherein the surface of the floor is to engage a second surface of at least one of the play yard or the bassinet when the floor is secured to the at least one of the play yard or the bassinet.

5. The apparatus of claim 1, wherein the connector is to remain engaged with the floor when the floor is secured to the at least one of the play yard or the bassinet.

6. The apparatus of claim 1, wherein the connector is to remain engaged with the floor when the floor is removed from the at least one of the play yard or the bassinet.

7. An apparatus comprising:

a floor removably securable to at least one of a play yard or a bassinet;

a connector coupled to a surface of the floor adjacent a perimeter edge of the floor, the connector having an opening positioned adjacent the edge of the floor to the cooperate with a first fastener, the connector including a based having the opening formed therein, the base of the connector attached to a surface of the floor via a second fastener; and a play gym having a first leg including the first fastener, the play gym being removably coupled to the connector via the first fastener, wherein the second fastener is oriented in a first position when the play gym is coupled to the connector and in a second position when the play gym is decoupled from the connector, the first position being different from the second position.

8. An apparatus comprising:

a floor postionable in at least one of a play yard or a bassinet; and a play gym removably coupled to the floor, the play gym to suspend an object above at least one of the play yard or the bassinet when the play gym is coupled to at least one of the floor, the play gym, or the bassinet and the floor is positioned in the at least one of the play yard or the bassinet, the play gym including:

a hub having a first plurality of cavities and a second plurality of cavities adjacent the respective ones of the first plurality of cavities; and a plurality of legs, a first end of each of the legs to be received in respective ones of the first plurality of cavities of the hub when the play gym is in a use position, and the first ends of the legs to be removed from the respective ones of the first plurality of cavities when the play gym is in a stored position, the legs to remain attached to the hub when the play gym is in the stored position, the first end of each of the respective legs to couple to respective ones of the second plurality cavities when the play gym is in the stored position.

9. The apparatus of claim 8, further including a plurality of connectors attached to the floor, when the legs are coupled to the floor, each of the legs is to engage a respective one of the connectors.

10. The apparatus of claim 9, wherein each of the connectors includes an opening to receive a respective one of the legs.

* * * * *